US009513035B2

(12) United States Patent
Wise et al.

(10) Patent No.: US 9,513,035 B2
(45) Date of Patent: Dec. 6, 2016

(54) COOLING APPARATUS

(71) Applicant: KOOLKWIC LIMITED, Shrewsbury, Shropshire (GB)

(72) Inventors: Roger Wise, Bridgnorth (GB); David Jeavons, Bridgnorth (GB)

(73) Assignee: KOOLWIC LIMITED, Shrewsbury, Shropshire (GB)

( * ) Notice: Subject to any disclaimer, the term of this patent is extended or adjusted under 35 U.S.C. 154(b) by 385 days.

(21) Appl. No.: 14/047,696

(22) Filed: Oct. 7, 2013

(65) Prior Publication Data

US 2014/0060085 A1 Mar. 6, 2014

Related U.S. Application Data

(63) Continuation of application No. PCT/GB5012/050699, filed on Mar. 29, 2012.

(60) Provisional application No. 61/551,541, filed on Oct. 26, 2011.

(30) Foreign Application Priority Data

| | | |
|---|---|---|
| Apr. 5, 2011 | (GB) | 1105753.6 |
| May 20, 2011 | (GB) | 1108492.8 |
| Dec. 13, 2011 | (GB) | 1121390.7 |
| Feb. 23, 2012 | (GB) | 1203157.1 |

(51) Int. Cl.
*F25B 21/02* (2006.01)

(52) U.S. Cl.
CPC ..... *F25B 21/02* (2013.01); *F25B 2321/025* (2013.01)

(58) Field of Classification Search
CPC ..... F25B 2321/025
See application file for complete search history.

(56) References Cited

U.S. PATENT DOCUMENTS

| | | | | |
|---|---|---|---|---|
| 3,052,100 | A | 9/1962 | Homkes | |
| 7,866,164 | B2 * | 1/2011 | Rice | B60H 1/00478 62/259.3 |
| 2003/0194529 | A1 * | 10/2003 | Bersted et al. | 428/97 |
| 2004/0025516 | A1 | 2/2004 | Van Winkle | |
| 2005/0284117 | A1 * | 12/2005 | Swars | B01D 46/0001 55/497 |
| 2006/0168969 | A1 * | 8/2006 | Mei | F25B 21/02 62/3.7 |
| 2007/0034356 | A1 * | 2/2007 | Kenny | F04B 17/00 165/80.4 |
| 2007/0199333 | A1 * | 8/2007 | Windisch | A41D 13/0051 62/3.5 |
| 2009/0084112 | A1 | 4/2009 | Ham | |
| 2010/0031674 | A1 | 2/2010 | Aldrich | |
| 2011/0042041 | A1 * | 2/2011 | Zrodnikov | F28C 3/005 165/104.19 |

FOREIGN PATENT DOCUMENTS

| | | | |
|---|---|---|---|
| JP | 2005300101 | A | 10/2005 |
| WO | 9738607 | A1 | 10/1997 |

* cited by examiner

*Primary Examiner* — Emmanuel Duke
(74) *Attorney, Agent, or Firm* — King & Schickli, PLLC

(57) ABSTRACT

Cooling apparatus including a thermoelectric device (1618) either forming at least part of at least one body (1614, 1616) to be cooled, or being positioned adjacent, in use, at least one body to be cooled, wherein the at least one body contains coolant.

4 Claims, 24 Drawing Sheets

COOLING APPARATUS

FIELD OF THE INVENTION

The present invention relates to cooling apparatus.

BACKGROUND OF THE INVENTION

There are many types of known heating/cooling devices. Devices that use the Peltier effect have advantages in terms of energy consumption. These devices are thermoelectric and electric power is used to generate to temperature difference between the two sides of the device. However, such devices are not conventionally widely used in many applications, but the present inventors have discovered that in some cases providing additional heating/cooling means can make use of such devices viable in many situations where they were not previously used.

SUMMARY OF THE INVETNION

According to a first aspect of the present invention there is provided cooling apparatus including:

a thermoelectric device either forming at least part of at least one body to be cooled, or being positioned adjacent, in use, at least one body to be cooled, the at least one body containing coolant.

The body may be in flow communication with a device for causing the fluid/coolant to flow through the body. The body may include an arrangement for creating turbulence in the flowing coolant. The device and the at least one body can be in flow communication by means of at least one conduit. A said conduit may be connected to the device or a said body by means of a dry-break joint.

A said body may comprise a shelf removably fitted within a housing. Alternatively or additionally, a said body may comprise an open container removably fitted within the housing. The housing can be in a form of an open box or a frame. The apparatus may further include a door/lid for the housing. The door/lid being can be in a form of a further thermoelectric device. The thermoelectric device may form at least one surface of a refrigerator, cooling cabinet, freezer or a fluid dispenser.

The thermoelectric device can be fitted within an assembly removably fitted within the housing. The thermoelectric device assembly can include a fan and a pump for transferring the coolant through the fan unit and the at least one body. The fan may be located adjacent a heat sink inside the assembly. The assembly can further include a thermostat or electronic controller for the thermoelectric device. Cables associated with the controller and other components of the apparatus can be plug/socket type arrangements.

According to a general aspect of the present invention there is provided heating/cooling apparatus including:

a thermoelectric device forming at least part of a surface to be heated/cooled, or positioned adjacent, in use, a surface to be heated/cooled.

The cooling device may include a flat surface upon which, in use, at least one drinking vessel can be placed. An upper portion of the at least one drinking vessel can be left exposed to atmosphere.

The cooling device may include a housing including at least one conduit for transferring cooled fluid beneath the flat surface. The at least one conduit may be in contact with, or located adjacent (e.g. no more than 1 cm away from) an underside of the flat surface. The cooling device may further include an additional housing for holding other components of the device. In use, the cooling device may be set up on a bar or table.

The upper surface may be part of a table or bar. The upper surface may act as a cover for a compartment formed within at least part of the table or bar. At least one conduit may be located inside the compartment. A housing may be removably mounted on the table, e.g. to a surface opposite the upper surface. The removable housing can include at least some of the components of the cooling device.

A cooling plate may be fixed underneath at least part of the upper surface. The cooling plate may comprise a cold plate of the thermoelectric device. The cooling plate can include at least one channel/bore that extends through from its lower surface to its upper surface. For instance, the cooling plate can have a grid/matrix-like arrangement of bores. At least one fan device can be located adjacent the cooling plate, in use, the at least one fan device directing cold air through the at least one channel/bore towards the upper surface. An axis of the at least one fan devices may be substantially parallel with the bores in the cooling plate. In some embodiments, there may be at least one channel/bore in the upper surface, at least some of which may be aligned with the at least one channel/bore in the cooling plate.

The cooling device may be used to cool beverages that are, in use, dispensed via a pump and valve/handle mechanism. The cooling device may be located downstream of the pump and the valve/handle mechanism. In one embodiment, the beverage is cooled in a container that includes at least one further cooling device, which may include at least one thermoelectric device. The container may include at least one conduit that, in use, has cooled fluid flowing within it. The at least one conduit may comprise a coil-shaped conduit that extends at least partially between ends of the container.

In some embodiments the cooling device may be in the form of an open box. A door/lid for the open box may further be in a form of a thermoelectric device. In some embodiments the thermoelectric device forms at least one surface of a refrigerator, cooling cabinet or freezer, or a fluid dispenser. In other embodiments the thermoelectric device forms at least one surface of an oven. All external surfaces of the apparatus may be formed of at least one thermoelectric device.

The thermoelectric device may have a plurality of outwardly extending fins that function as heat sinks.

A hot side of the thermoelectric device may be cooled by a liquid jacket or a fan.

The thermoelectric device may be located adjacent, or abut, a wall containing fluid/coolant. The wall may be in flow communication with a device for causing the fluid/coolant to flow within the wall. The wall may comprise an arrangement for creating turbulence within the fluid/coolant flowing within the wall.

The surface to be cooled may comprise a floor, with the thermoelectric device being positioned, in use, below a lower surface of the floor.

The apparatus may further include:

a radiator device, the thermoelectric device being configured to cool coolant flowing through the first radiator, and a transfer device for transferring the coolant between the radiator device and the thermoelectric cooling device.

The cooling apparatus may further include:

a second radiator device located downstream of the first-mentioned radiator device, and a second thermoelectric device configured to cool the coolant flowing through the second radiator.

The transfer device may be configured to transfer the coolant between the second radiator device and the second thermoelectric cooling device as well as the between the firstmentioned radiator device and the firstmentioned thermoelectric cooling device. Alternatively, a further transfer device may be provided to transfer the coolant between the second radiator device and the second thermoelectric cooling device. The transfer device may comprise a pump.

The apparatus may further include a third thermoelectric cooling device located downstream of the second radiator device. The apparatus may further include a further thermoelectric cooling device located between the firstmentioned radiator device and the second radiator device.

The firstmentioned and the second radiator devices (at least) may be located within a housing. The housing may be at least partially formed of thermoelectric cooling structures. The housing may be at least partially formed of a wall containing fluid/coolant. The wall may comprise an arrangement for creating turbulence in the fluid/coolant as it flows within the wall. In some embodiments, the housing may be fully formed from at least one thermoelectric cooling structure, thereby encasing the firstmentioned and the second radiator devices. The firstmentioned and the second thermoelectric cooling devices may be located outside the housing. In some embodiments at least part of the housing is formed from at least one Peltier structure located adjacent/abutting a wall containing fluid/coolant. The housing may be insulated.

Some embodiments of the apparatus may further include a subsidiary cooling system. The subsidiary cooling system may comprise a fan and at least one heat exchanger located adjacent the cooling apparatus. The at least one heat exchanger may comprise a Peltier unit. The system may further include a device for transferring coolant to the at least one heat exchanger.

In some embodiments the cooling apparatus forms a cabinet at least partially formed of fluid-containing walls, which may be arranged to create turbulence. A fan unit may be located adjacent a said wall and a transfer device may be arrange to transfer coolant through the fan and the wall(s). The fan may be located adjacent a heat sink (which can comprise a plurality of fins) adjacent a Peltier unit.

The thermoelectric device may comprise a Peltier device including a heat sink (e.g. formed of alloy) covering a hot side of the Peltier device.

The cooling apparatus can form an air induction device for a combustion engine, the induction device being at least partially formed of the thermoelectric device. The induction device may comprise an air intake for a racing car.

According to another aspect of the present invention there is provided cooling apparatus including:

a radiator device;

a thermoelectric device configured to cool coolant flowing through the first radiator, and a transfer device for transferring the coolant between the radiator device and the thermoelectric cooling device.

According to yet another aspect of the present invention there is provided a cabinet having an internal surface at least partially formed of a thermoelectric device.

According to yet another aspect of the present invention there is provided a thermoelectric device configured, in use, to heat a lower surface of a floor.

According to a further aspect of the present invention there is provided a wall structure including an arrangement for creating turbulence in fluid flowing within the wall.

According to another aspect of the present invention there is provided combustion engine air induction system cooling apparatus including or comprising:

a cooling arrangement cooled by a thermoelectric device, the cooling arrangement either forming part of the combustion engine air induction system, or the cooling arrangement being positioned within or adjacent, in use, the combustion engine air induction system, wherein the cooling arrangement contains, in use, fluid cooled by the thermoelectric device, and wherein the cooling arrangement is at least partially coil-shaped and/or includes convolutions.

The combustion engine component may include an engine air intake unit. The apparatus may include a cooling arrangement fitted inside the intake unit, the cooling arrangement containing, in use, fluid cooled by the thermoelectric device. The cooling arrangement may be coil shaped. The cooling arrangement may extend from an intake end of the intake unit to an opposite end of the intake unit. The cooling arrangement may be hollow and transfers cooling fluid from an inlet conduit though a coil-shaped portion and to an outlet conduit.

The inlet conduit may be in flow communication with a heat exchanger component containing fluid. The heat exchanger component can include a Peltier unit. A heat exchanger inlet conduit can be used to transfer the fluid into the heat exchanger component from a radiator component. The radiator component may be fitted with a fan. A heat exchanger outlet conduit may transfer fluid from the heat exchanger component back to the radiator component, by means of a pump. Dry break joints may be provided in the heat exchanger inlet and outlet conduits. Dry break joints may be provided for the cooling arrangement inlet and/or outlet. Cooling fluid can be transferred from the outlet conduit of the cooling arrangement into the heat exchanger by means of a pump. A variable-speed fan may be fitted may be fitted adjacent the intake end of the intake unit.

The combustion engine component may include a plenum chamber, located between an intake unit and cylinders of the combustion engine. A cooling arrangement can be fitted within the plenum chamber and may comprise a hollow conduit for transferring cooling fluid from an inlet, though a series of convolutions/conduit matrix within the plenum chamber and to an outlet. The inlet may be in flow communication with a heat exchanger, which can contain fluid and can include a Peltier unit. A heat exchanger inlet conduit can transfer cooling fluid into the heat exchanger from a radiator component that can be fitted with a fan. A heat exchanger outlet conduit may transfers fluid from the heat exchanger to the radiator component, by means of a pump. Dry break joints may be provided for the heat exchanger inlet and/or outlet conduits. Dry break joints may be provided for the cooling arrangement inlet and/or outlet. Cooling fluid can be transferred from the outlet of the cooling arrangement into the heat exchanger by means of a pump.

The cooling device may, in use, be fitted between a turbocharger and the combustion engine so that the cooling device, in use, cools compressed air leaving the turbocharger, thereby replacing a conventional intercooler.

Dry break joints can, in use, connect the cooling device to the turbocharger and/or the engine. Electrical connections between the cooling device and those components can also be plug/socket type arrangements According to another aspect of the present invention there is provided an engine including cooling apparatus substantially as described herein.

According to a further aspect of the present invention there is provided a vehicle including engine component cooling apparatus substantially as described herein.

According to a general aspect of the present invention there is provided combustion engine component cooling apparatus including or comprising:

a cooling arrangement cooled by a thermoelectric device, the cooling arrangement either forming at least part of the combustion engine component, or the cooling arrangement being positioned within or adjacent, in use, the combustion engine component.

Whilst the invention has been described above, it extends to any inventive combination of features set out above or in the following description.

Although illustrative embodiments of the invention are described in detail herein with reference to the accompanying drawings, it is to be understood that the invention is not limited to these precise embodiments. As such, many modifications and variations will be apparent to practitioners skilled in the art. Furthermore, it is contemplated that a particular feature described either individually or as part of an embodiment can be combined with other individually described features, or parts of other embodiments, even if the other features and embodiments make no mention of the particular feature. Thus, the invention extends to such specific combinations not already described.

BRIEF DISCRIPTION OF THE DRAWING FIGURES

The invention may be performed in various ways, and, by way of example only, embodiments thereof will now be described, reference being made to the accompanying drawings in which.

Figure 18A:
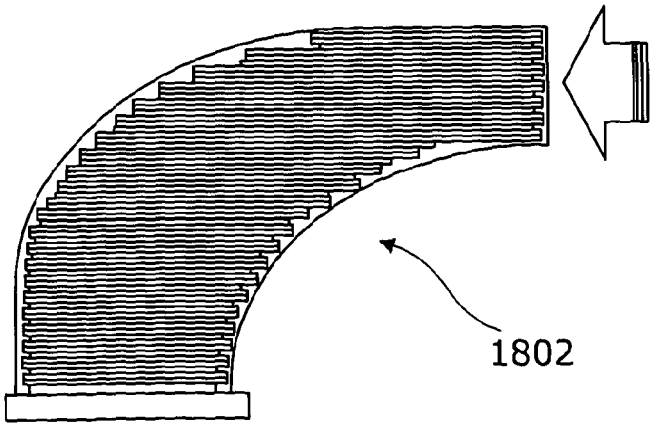
Figure 18B:
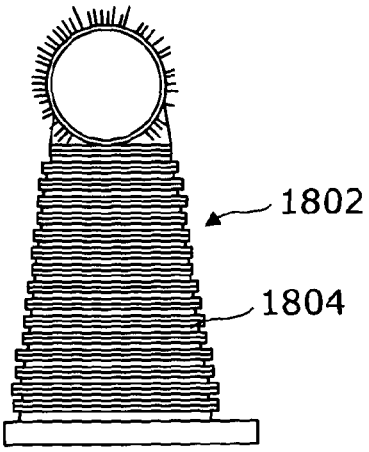
Figure 16:
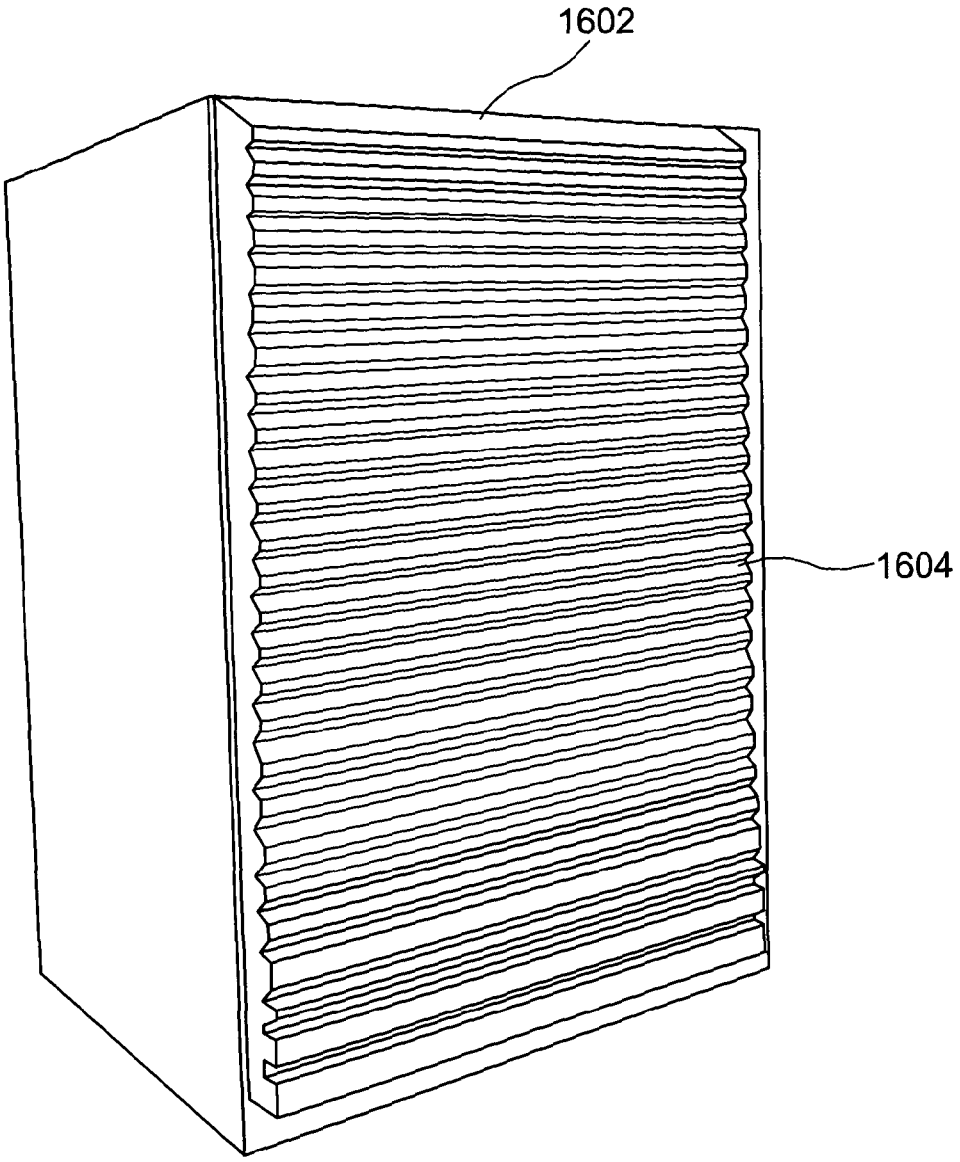
Figure 16B:
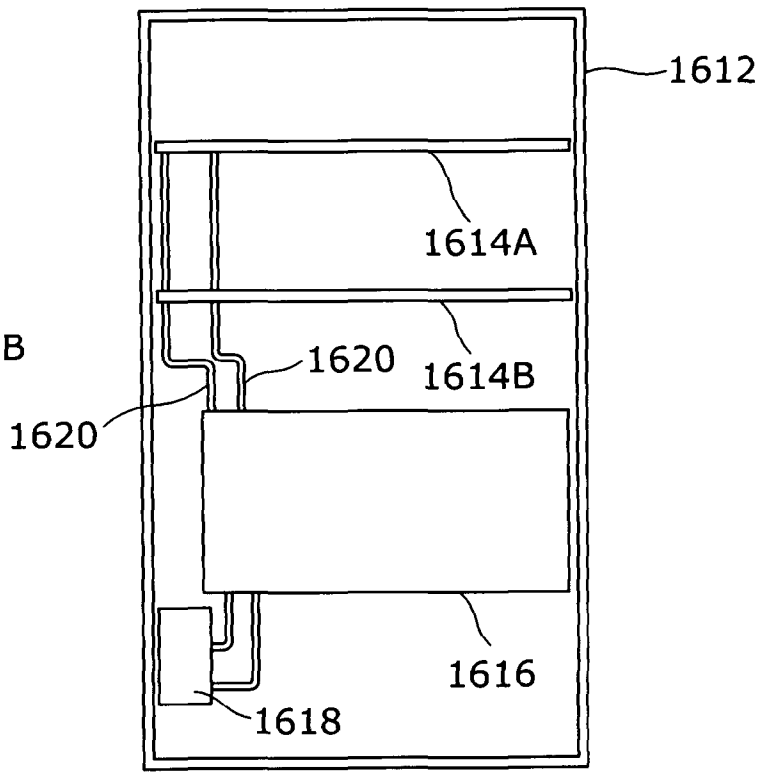
Figure 16A:
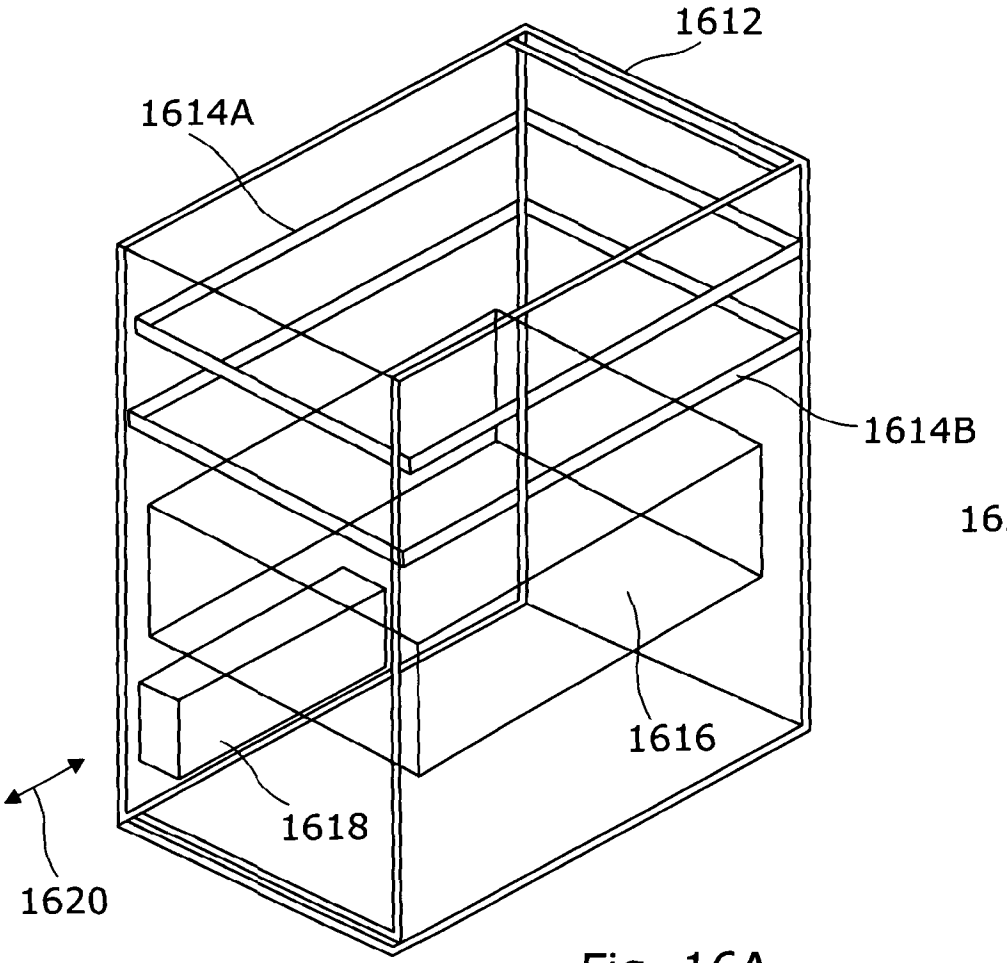
Figure 16C:
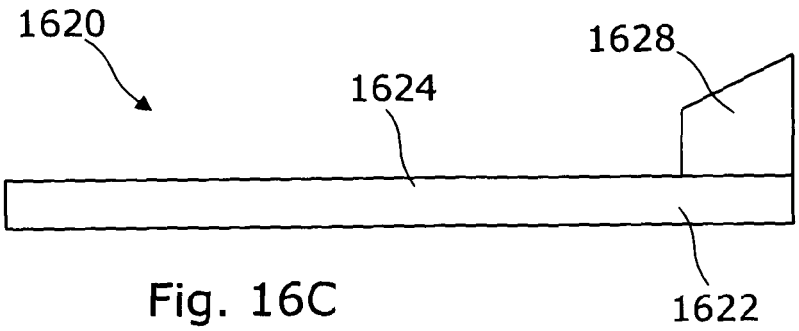
Figure 16D:
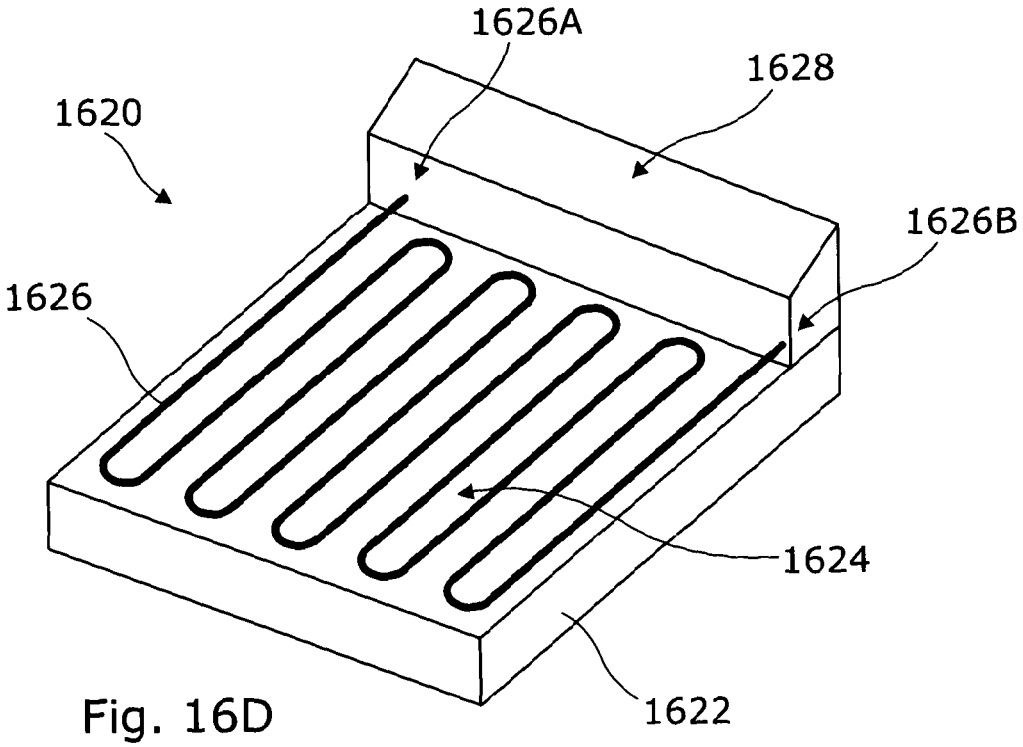
Figure 16E:
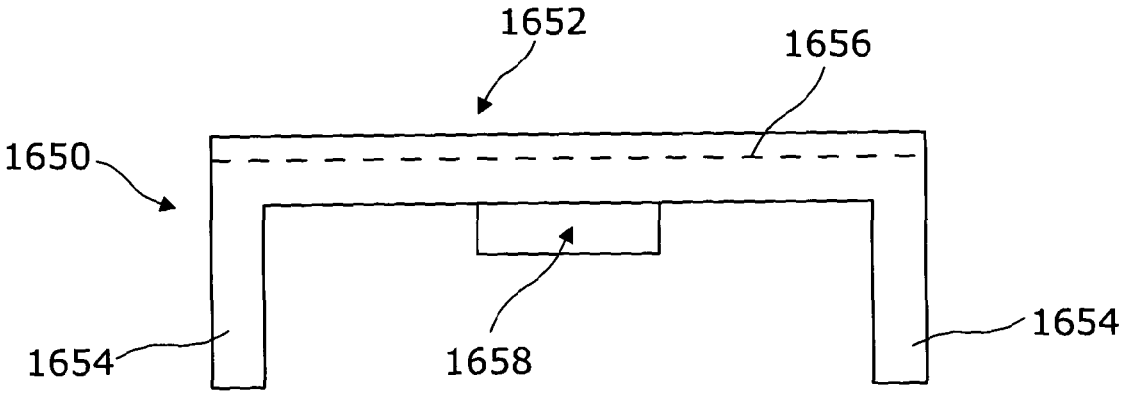
Figure 22:
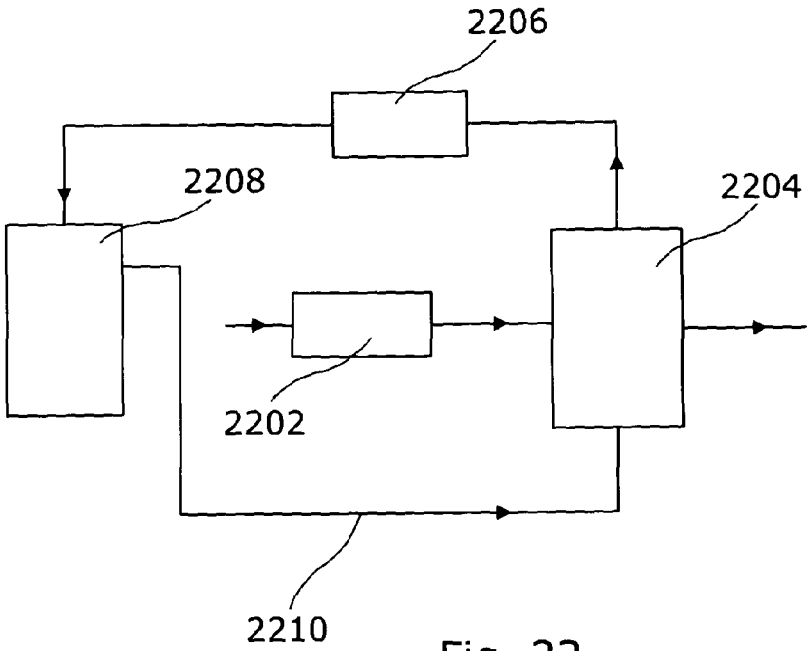
Figure 16F:
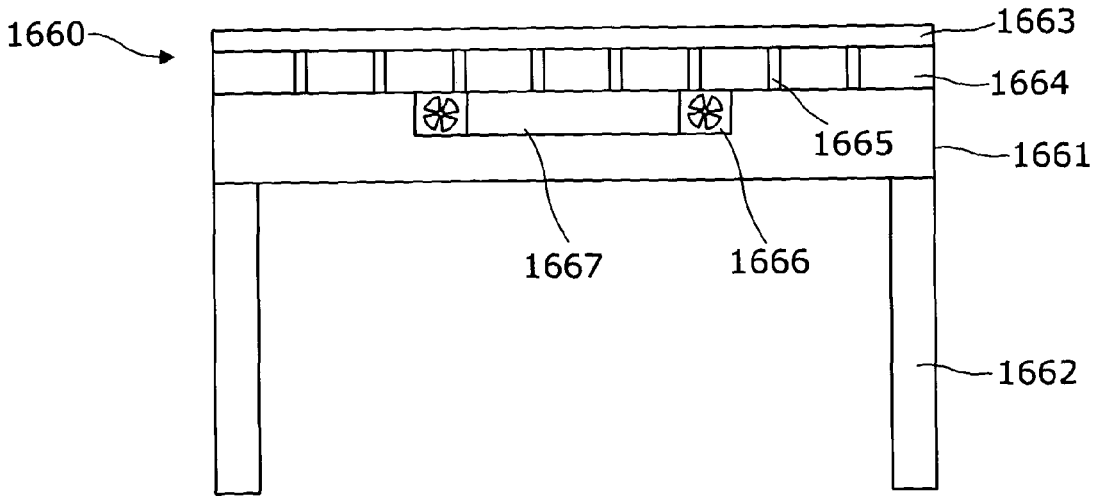
Figure 16G:
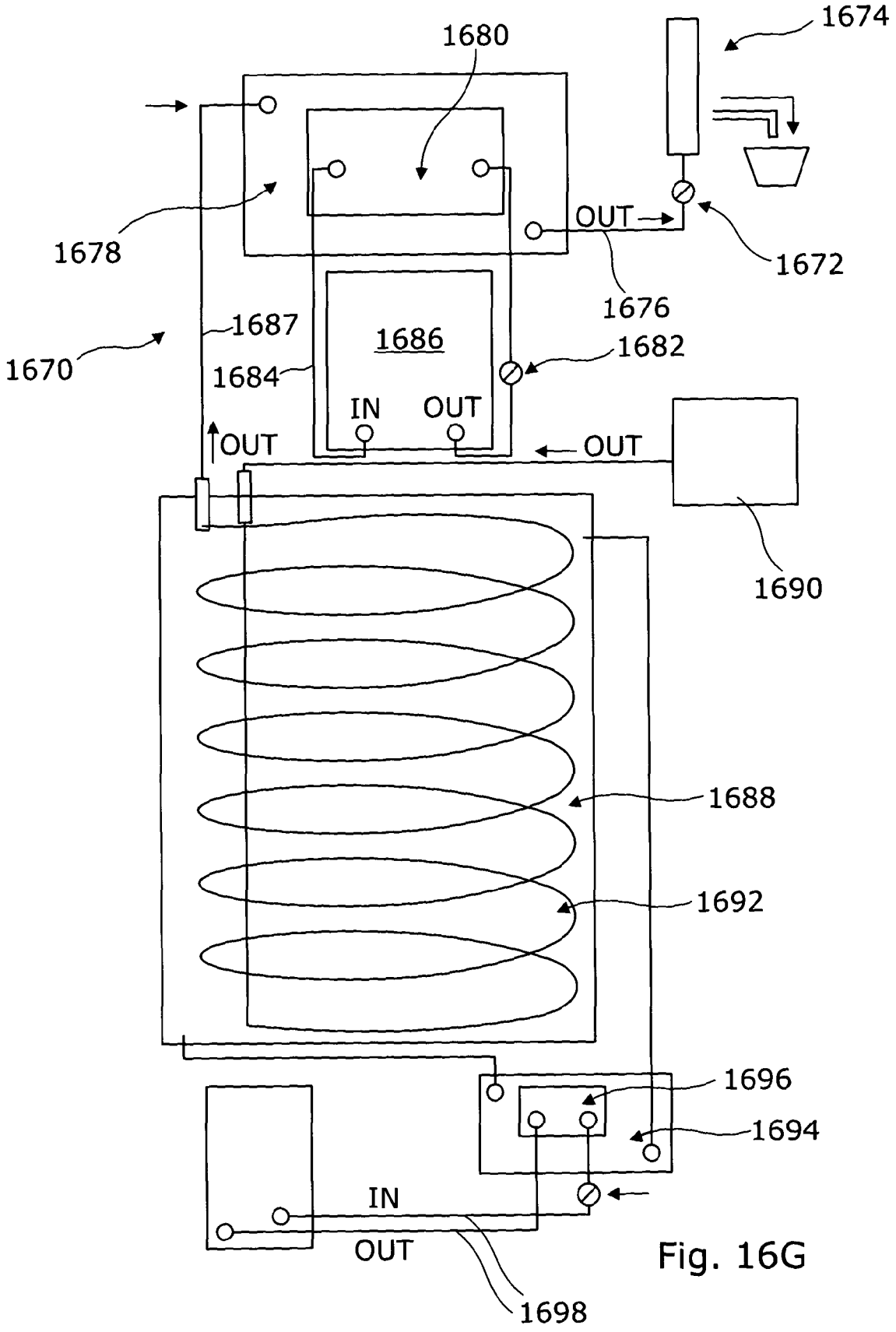
Figure 17:
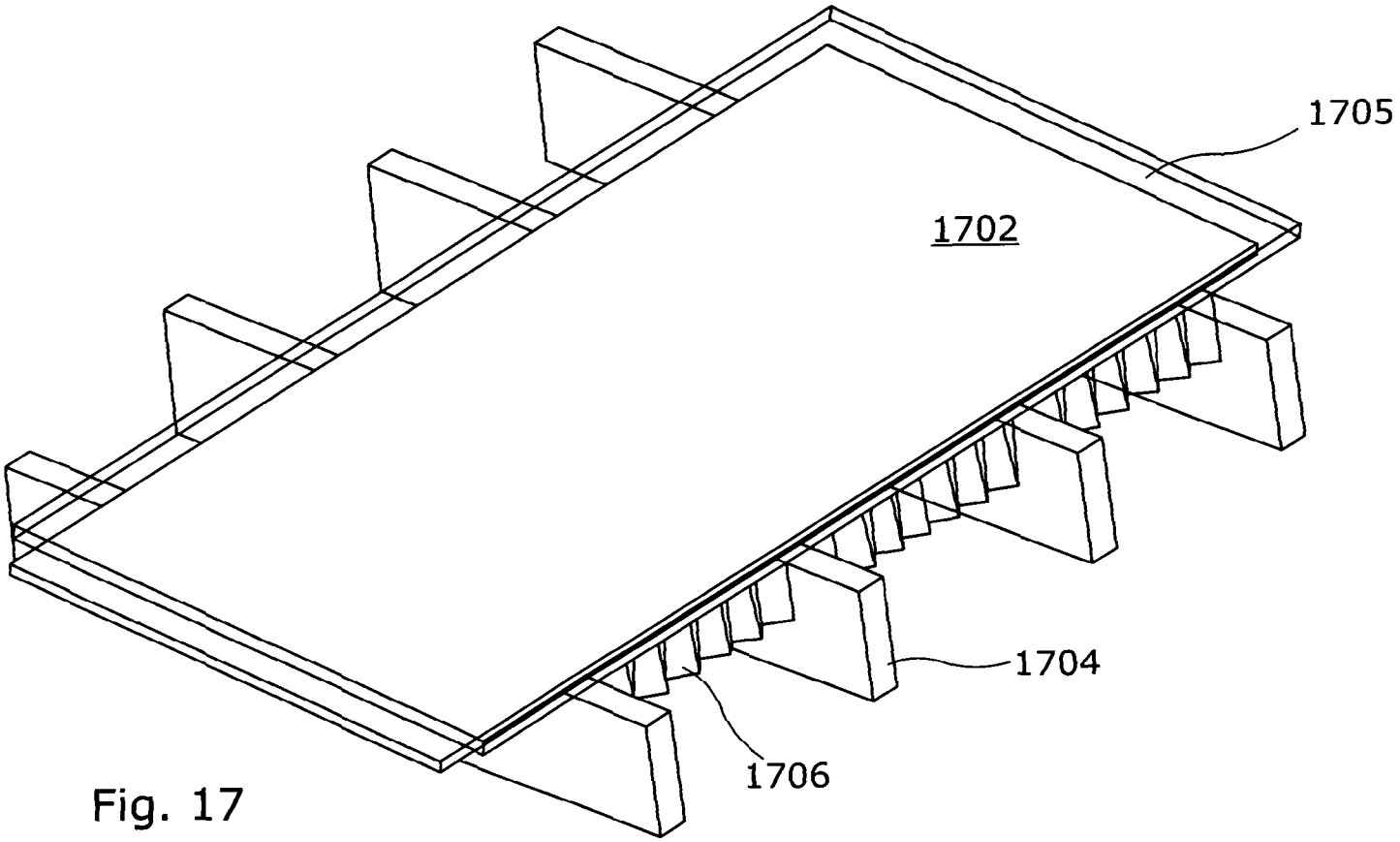
Figure 19A:
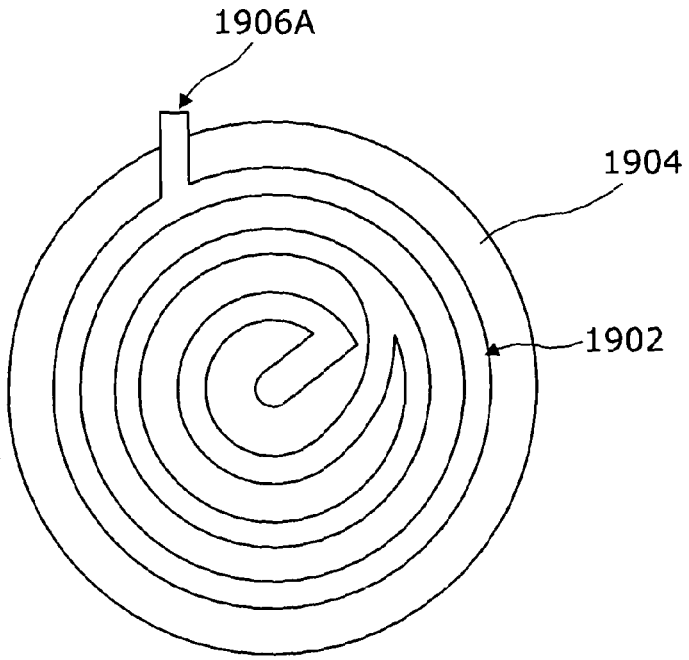
Figure 19B:
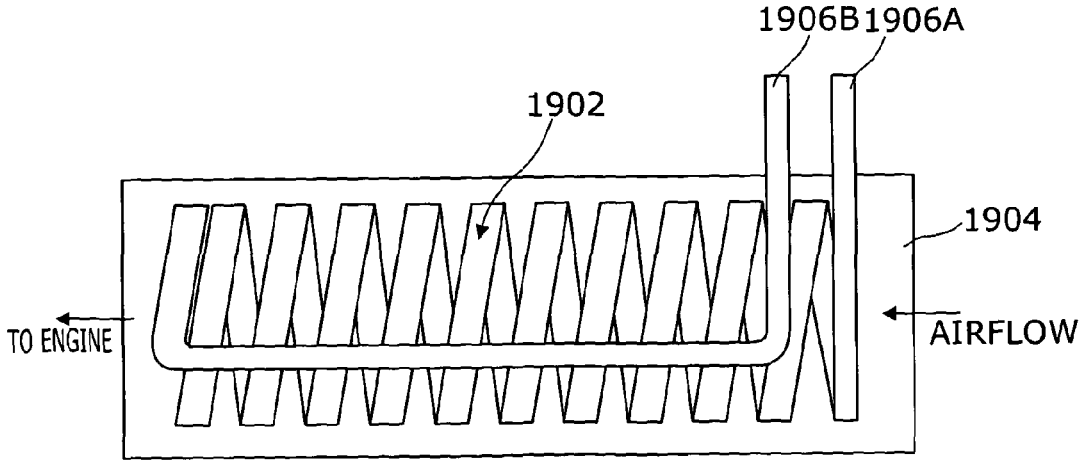
Figure 20:
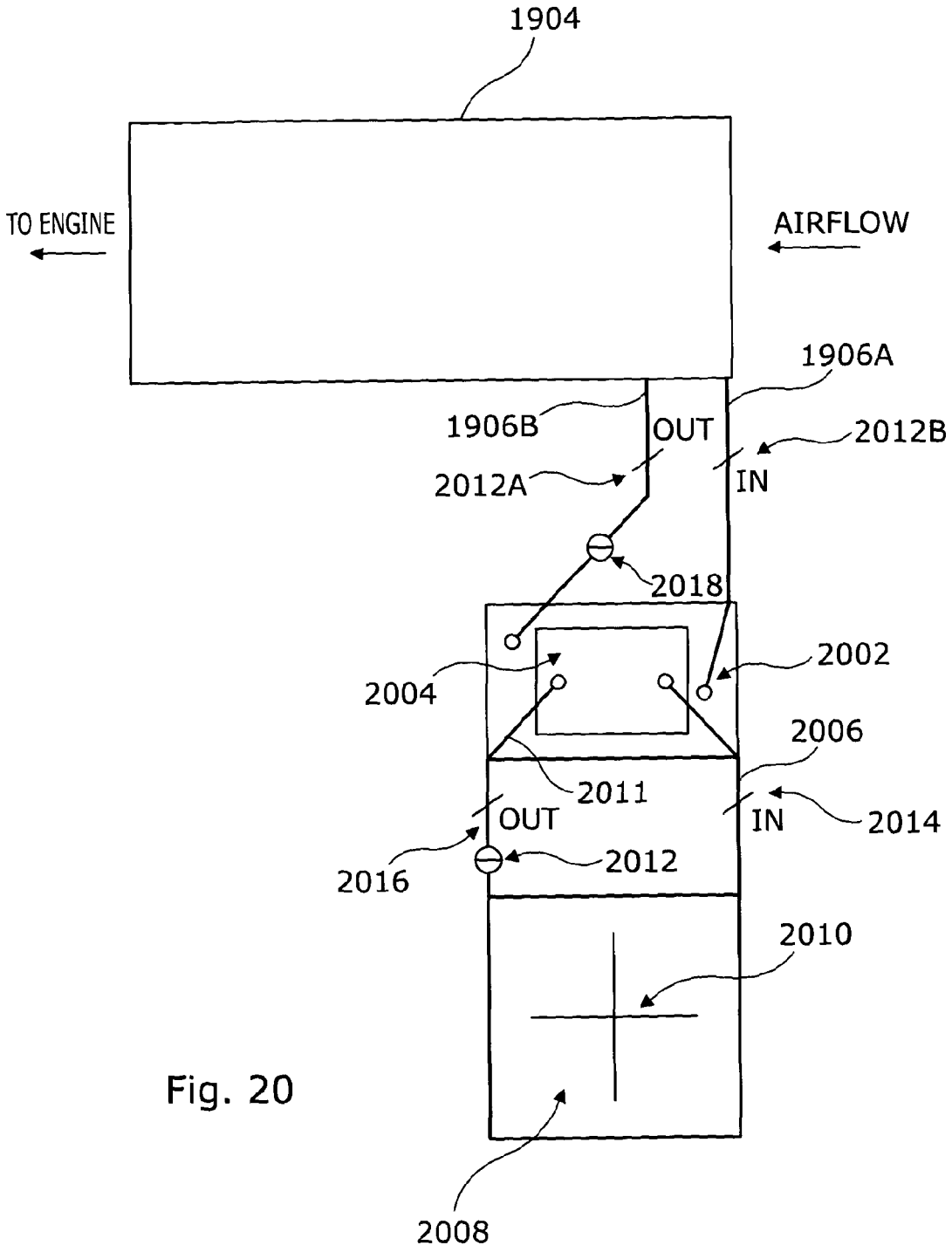
Figure 21:
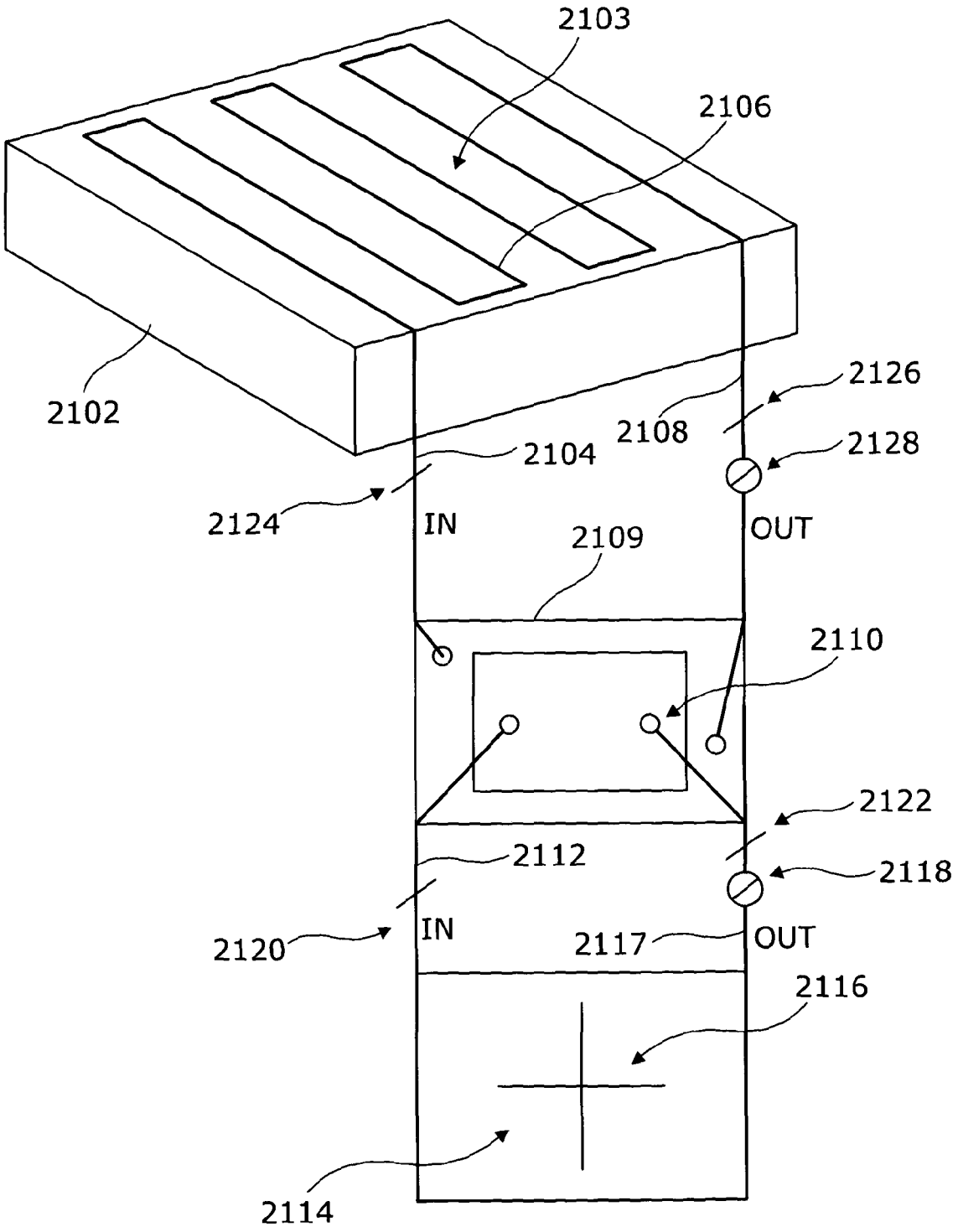

FIGS. 13-16 schematically illustrate examples of the apparatus that may be used as a refrigerator, cool cabinet or the like;

FIGS. 16A and 16B are perspective and side, respectively, schematic views of alternative embodiments useable as a refrigerator/cool cabinet;

FIGS. 16C and 16D are side and perspective views, respectively, of an embodiment useable as a table-top cooler;

FIG. 16E is a front view of an embodiment useable as a table;

FIG. 16F is a schematic drawing of another embodiment useable as a table;

FIG. 16G is a schematic diagram of an embodiment used to cool dispensed beverages;

FIG. 17 is a sectional side view of example apparatus used to heat a floor;

FIGS. 18A and 18B are side and front views, respectively, of an embodiment used in an air induction device for a combustion engine;

FIGS. 19A and 19B are side and front views, respectively, of another embodiment used in an air induction device for a combustion engine;

FIG. 20 is a schematic diagram of further components of the embodiment of FIGS. 19A and 19B;

FIG. 21 is a schematic diagram of another embodiment that is used to cool a plenum chamber of an engine, and FIG. 22 is a schematic diagram of yet another embodiment that can be used to cool an engine.

DETAILED DISCRIPTION OF THE INVENITON

Figure 1:
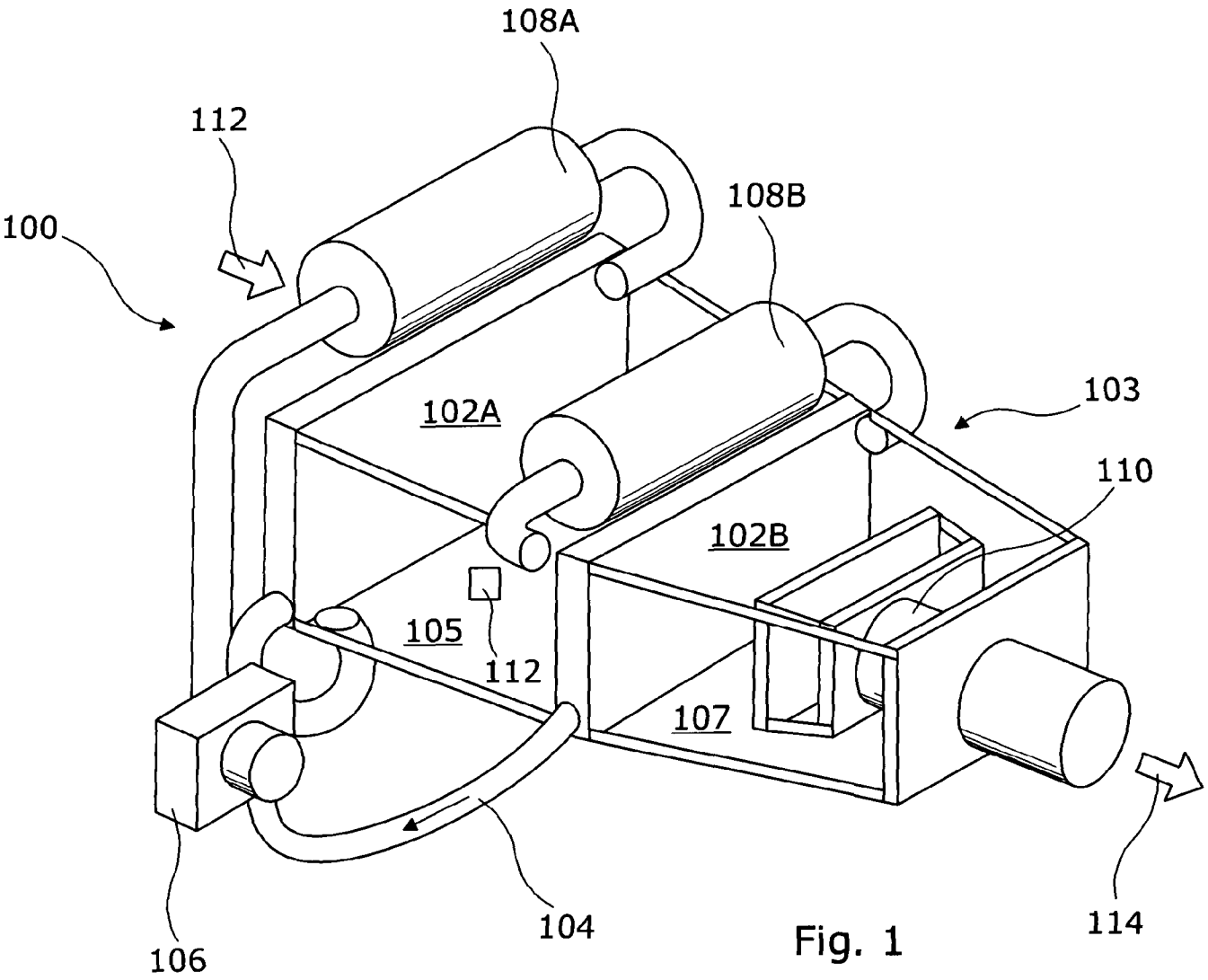
FIG. 1 is a schematic isometric view of a first embodiment.
Figure 2:
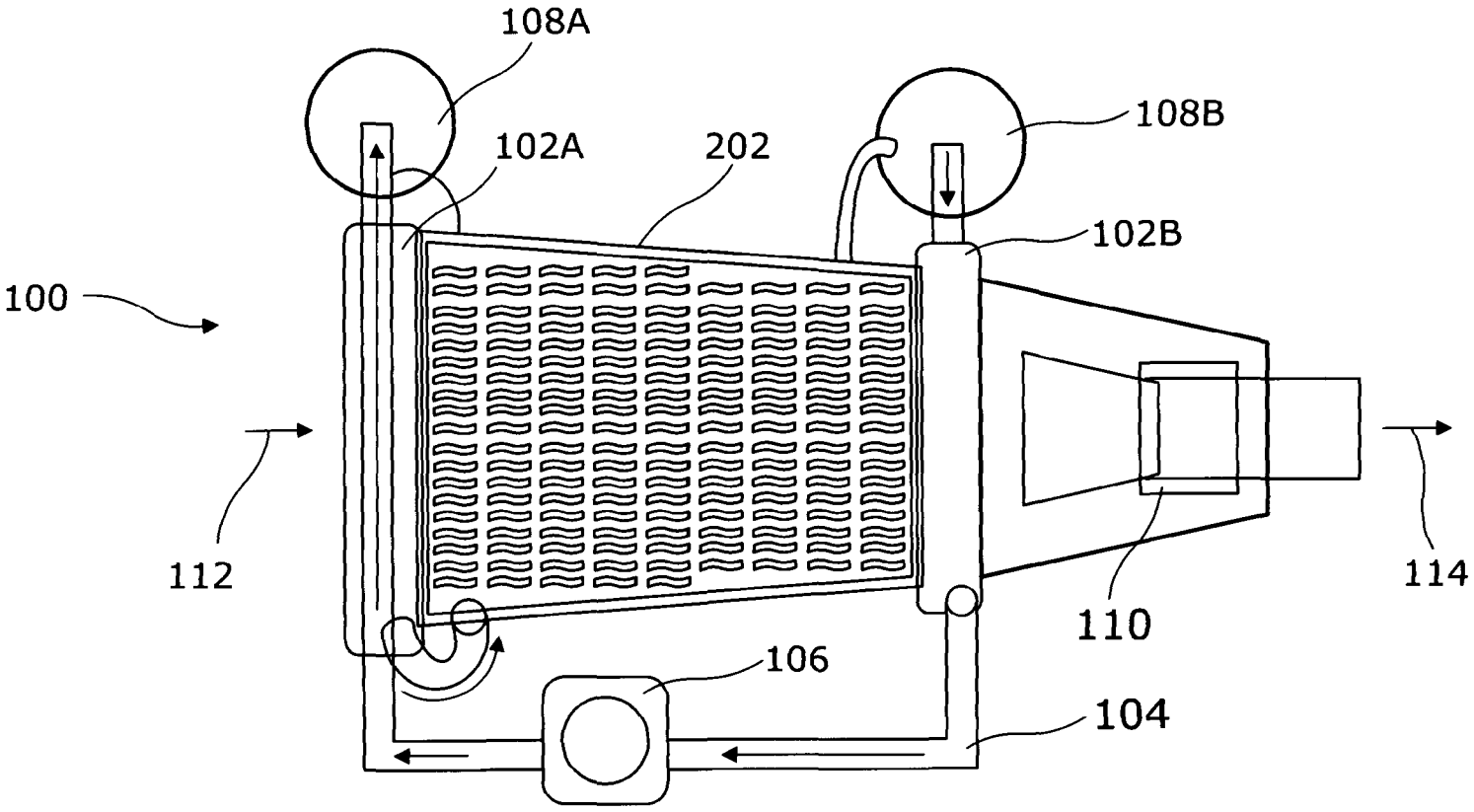
FIG. 2 is a schematic sectional side view of the embodiment of FIG. 1.

Referring to FIGS. 1 and 2, a first example apparatus 100 is a cooling apparatus including a first radiator 102A, which may be a liquid to air unit.

Circuitry for controlling the radiator will be well known to the skilled person and need not be described herein in detail. The radiator is located at one end of a framework 103 that forms a housing having a lower box-like section 105 and an upper box-like section 107. A conduit 104 (only partially shown in FIG. 1 for clarity) is connected to the first radiator as well as a pump 106. In some cases, the framework 103 may form part of the conduit.

A first thermoelectric device 108A is located outside the lower box-like section 105 of the framework, adjacent the first radiator device 102A. The first thermoelectric device comprises a Peltier cooler having a cylindrical shape with fins acting as heat sinks on its outer surface. Circuitry for controlling the thermoelectric devices (e.g. thermostatically) is not shown but will be well-known to the skilled person. Voltage/power regulation can be configured to exploit the low energy characteristics of the thermoelectric cooling devices. In this embodiment, as well as others, the main cooling effect may be provided by thermoelectric devices and other devices, such as fans or compressors, are either absent or used only as subsidiary coolers. These Peltier plates are very low energy devices and can be manufactured from a variety of metallic alloys, primarily aluminium, e.g. 1050A, incorporating a cast alloy one piece heat sink covering the entire "hot" side of the Peltier plate. The advantage of this structure of the alloy Peltier plate allows for far better retention and dissipation of heat/cold than conventional Peltier units. The specification of the alloy Peltier plate will depend on the required electrical performance for the installation. The physical size and geometry of the alloy Peltier plate will entirely depend on the size of the installation. The shape and contour of the Peltier alloy plate will entirely depend on the installation.

The cooling apparatus 100 further includes a second radiator device 102B, located beyond the upper end of the lower box-like section 105 and at the base end of the upper box-like section 107. The conduit 104 also connects the second radiator device to the pump 106 as well as a second thermoelectric cooling device 108B. The second thermoelectric cooling device is located outside the upper-box like section, adjacent the second radiator.

Optionally, a further thermoelectric cooling device 110 can be provided within the upper box-like section 107 is. Alternatively or additionally, a further thermoelectric cooling device 112 may be located within the lower box-like section 105. These further cooling devices may also include passive finned heat sinks on at least part of their outer surfaces.

As shown in FIG. 2, walls 202 may be fitted to the framework 103 in order to form housing for the lower and upper box-like sections 105, 107. The walls may partially or fully house these sections, e.g. typically four walls extend over the main side surfaces of each of the upper and lower box-like sections. One or more of these walls may at least partially comprise fluid-filled turbulator-like arrangements, which will be described below with reference to FIG. 3. The walls (and other components of the cooling apparatus) can be formed of lightweight, corrosion-resistant material, such as aluminium, and insulation (such as Polyether foam or rigid foams) can at least partially surround the walls. Example dimensions for the apparatus are as follow: Length: 45 cm; Height 23 cml; Width (at widest point) 43 cm, although it will be understood that in practice the size and shape of the apparatus will depend entirely on the application/performance required.

In use, the pump 106 is configured to transfer coolant through the first conduit (and possibly the framework 103) to a first thermoelectric cooling device 108A then into the first radiator 102A, and then into the second thermoelectric cooling device 108B and then the second radiator 102B, before the coolant is returned to the pump for recirculation. Therefore, these items form a closed loop through which coolant is continually circulated whilst the pump is operational. It will be understood by the skilled person that a device other than a pump could be used to transfer the coolant around the loop, e.g. a suction device. Air entering the cooling apparatus (illustrated by arrow 112) passes through the first radiator device 102A and is cooled by it. The cooled air then passes through the lower box-like section (via cooling device 112, if present) and through the second radiator device 102B. The cooled air then passes out of the cooling device, as shown by arrow 114. Experiments have shown that this apparatus can reduce the ambient temperature of about 30° C. to around 15° C. in a few seconds, using around 5-10 amps of power for the Peltier plates.

One suitable use for the arrangement described above is as a charge cooler in a vehicle engine. The cold air produced by the apparatus can be controlled by thermostats, and in combination with the engine electronic control unit, in order to determine the optimum air flow and temperature that enters the combustion engine, be it by fuel injection, turbo charging, super charging or any other means of induction. The configuration of pipe work connecting the heat exchangers and the radiators (the, optionally, the subsidiary cooling systems described below), fan size/diameter/airflow/RPM can be determined based on the size of the installation. A benefit of such an air cooled charge cooler is that it makes the inducted air cool and dense for internal combustion, thereby improving engine efficiency. Such engines may be present in any type of vehicle, including petrol or diesel based engines.

Figure 3A:
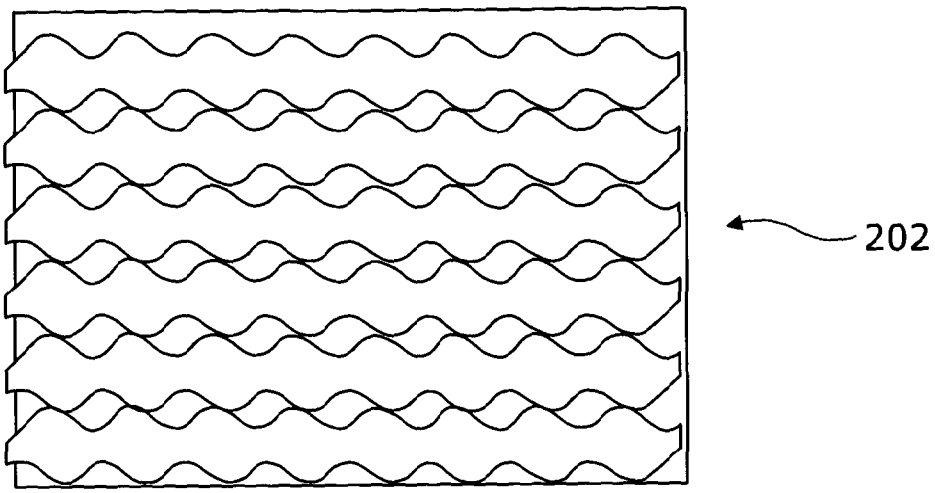
FIGS. 3A and 3B are drawings of a turbulator wall arrangement that can be used in embodiments of the apparatus.
Figure 3B:
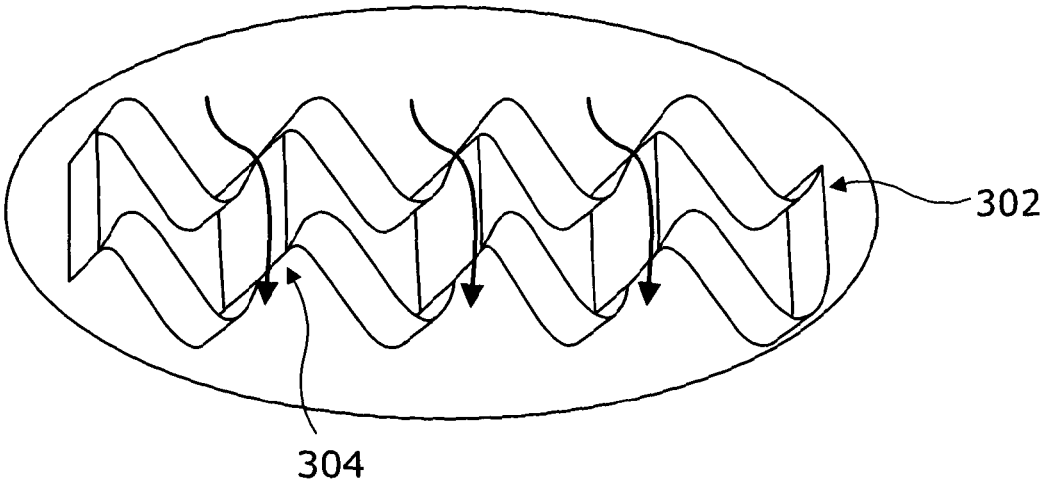

FIGS. 3A and 3B detail the construction of a wall 202. The wall comprises upper and lower plates (not shown) between which a layer 302 of material as shown in the Figure is sandwiched. The layer 302 may be formed of aluminium or any other suitable material. The layer comprises a grid-like arrangement of wave-like strips, with the peaks of the waves being fixed to the underside of the upper plate and the troughs of the waves being fixed to the upper surface of the lower plate. The angle of the strips between each trough and peak can be around 36°, for example. The strips include one-way intersections/bores 304 roughly midway between the peaks and troughs that are intended to create turbulent flow in order to effect good heat transfer. It will be appreciated that the design of the wall can be varied, e.g. bores may not be present between all pairs of peaks and troughs, adjacent strips may have different designs/angles, etc. The pump 106 may be used to cause fluid to flow through the walls, or one or more dedicated pumps can be provided.

Figure 4:
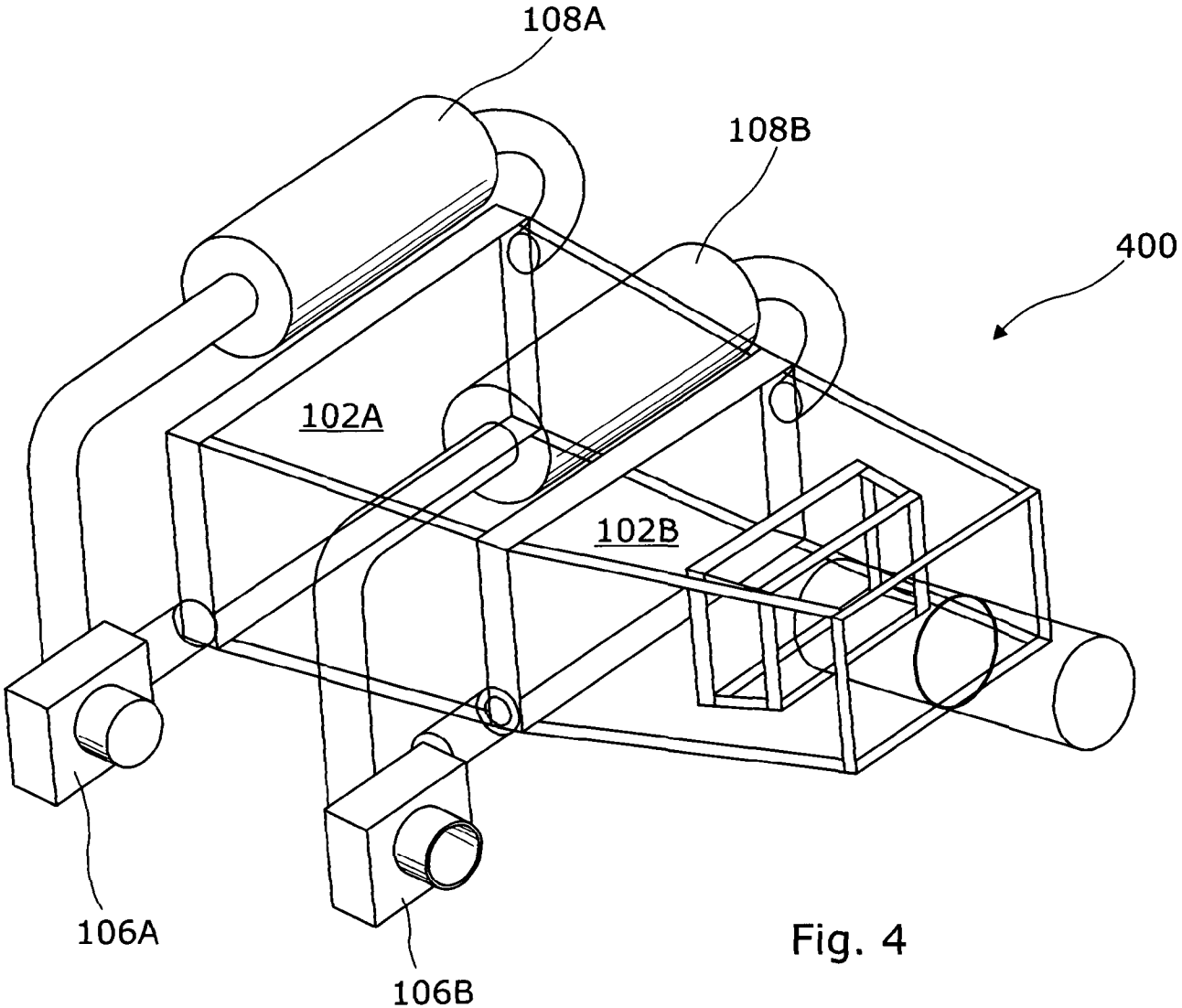
FIG. 4 is a schematic isometric view of a second embodiment.
Figure 5:
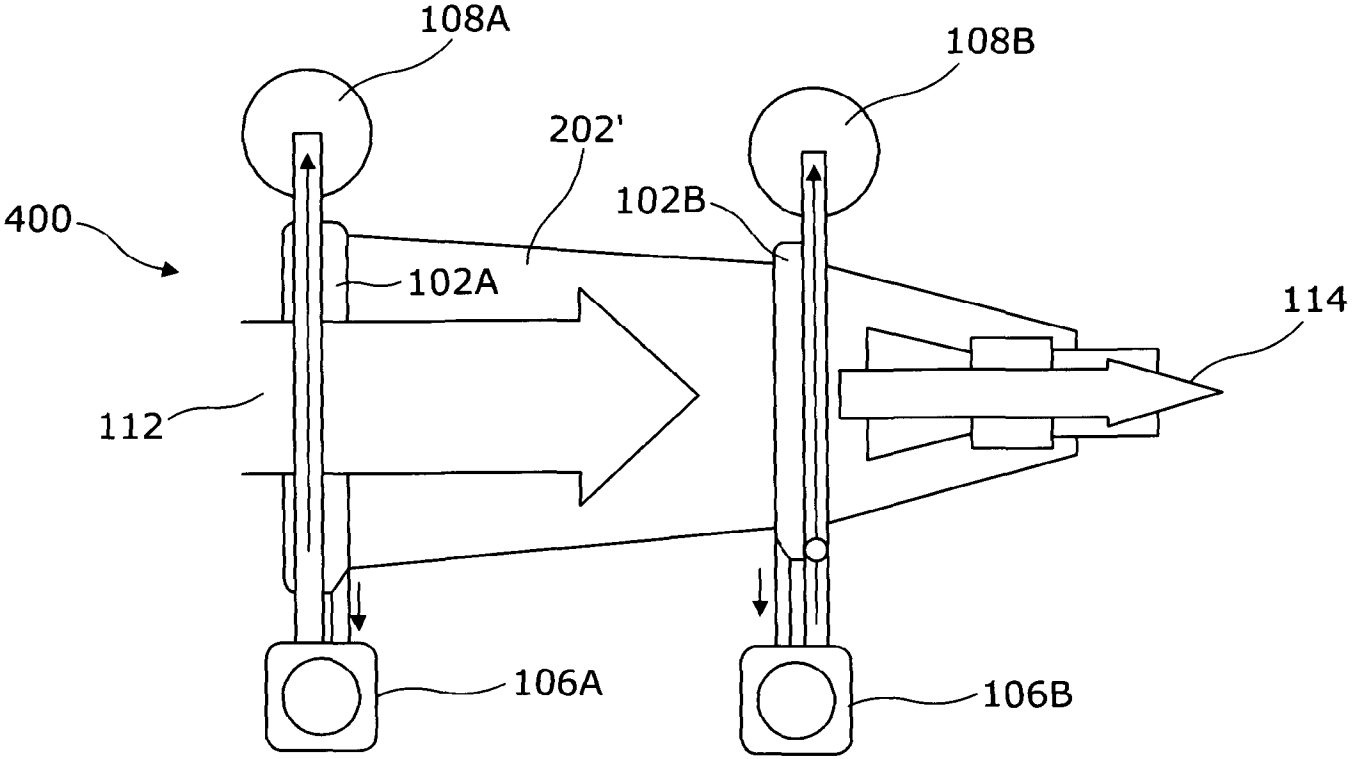
FIG. 5 is a schematic sectional side view of the embodiment of FIG. 4.

FIGS. 4 and 5 show a second embodiment 400 of the cooling device. Components identical/similar to the embodiment of FIGS. 1 and 2 have been given the same reference numerals. Unlike the first embodiment, the second embodiment includes two pumps 106A, 106B. The first pump 106A is used to transfer coolant around the first radiator 102A and thermoelectric cooling device 108A, whilst the second pump is used to transfer coolant around the second radiator 102B and second thermoelectric cooling device 108B. Thus, the two sets of components can be two separate closed loops. Further, instead of walls containing coolant, the walls 202' of this embodiment are formed of insulated aluminium.

Figure 6:
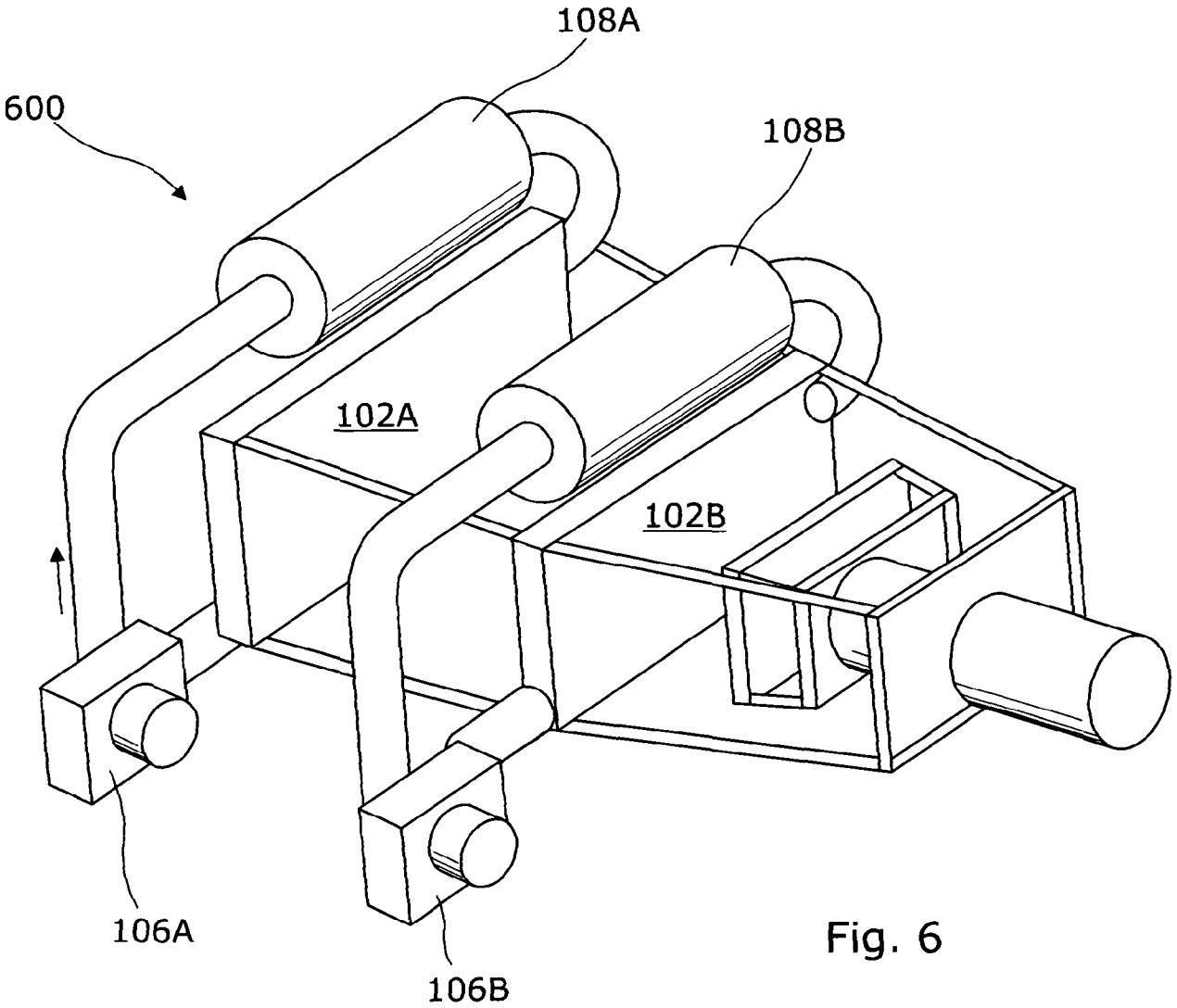
FIG. 6 is a schematic isometric view of a third embodiment.
Figure 7:
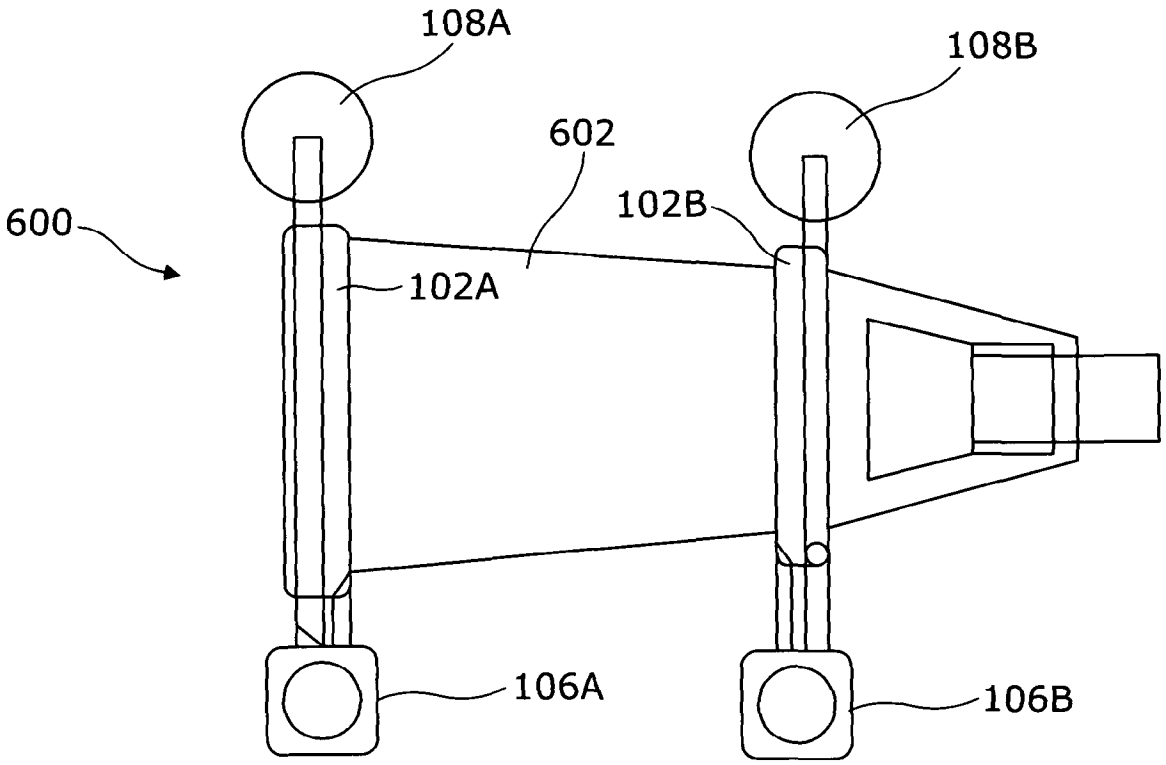
FIG. 7 is a schematic sectional side view of the embodiment of FIG. 6.

FIGS. 6 and 7 show a third embodiment 600 of the cooling device.

Components identical/similar to the previously-described embodiments have been given the same reference numerals. In this third embodiment, at least some of the walls 602 forming the housing can be (fully or partially) constructed from Peltier structures, which may have finned heat sinks. Suitable structures can be obtained from Thermonamic Electronics (Jiangxi) Corp., Ltd. of Jiangxi, P. R. China 330096.

Figure 8:
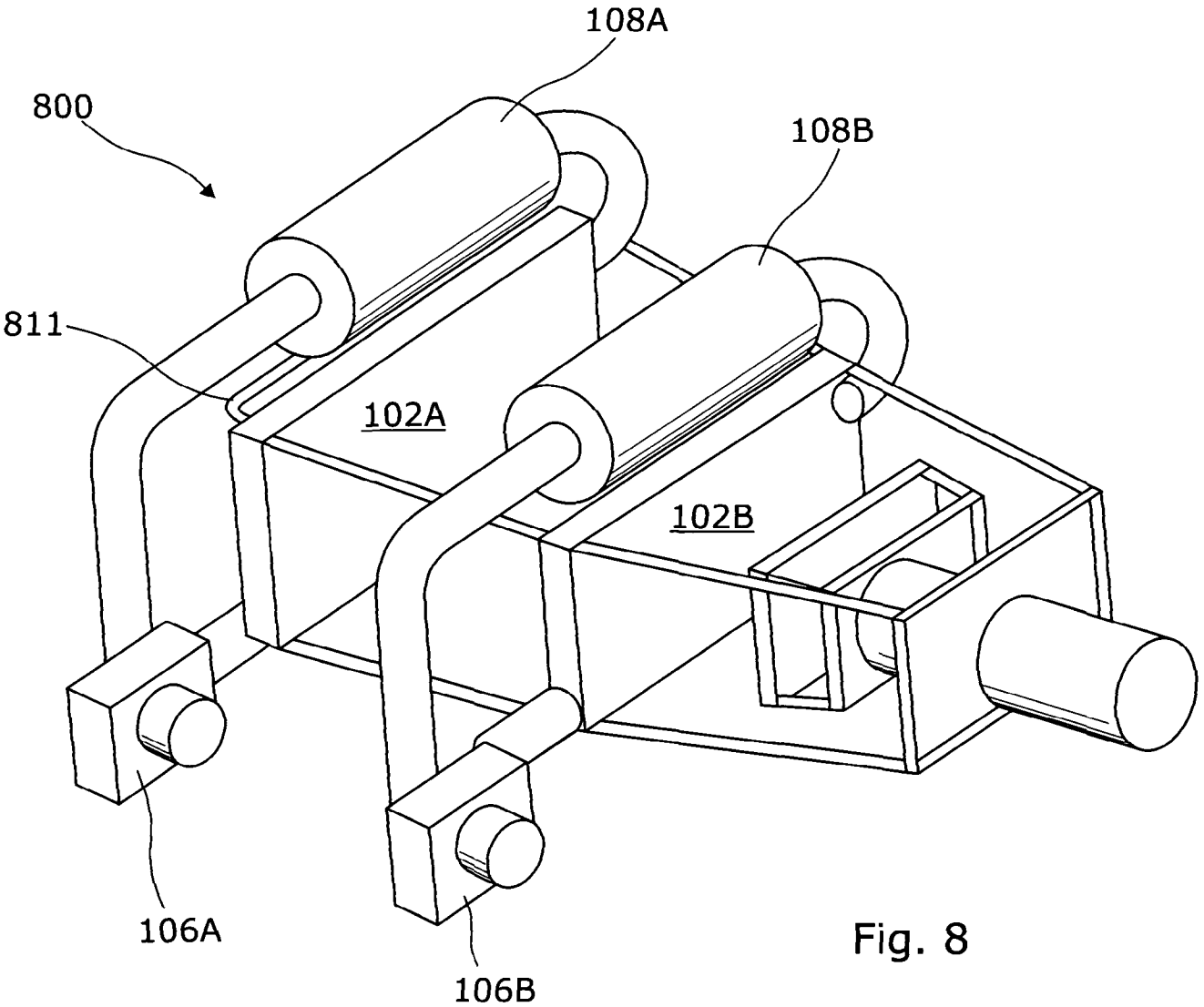
FIG. 8 is a schematic isometric view of a fourth embodiment.
Figure 9:
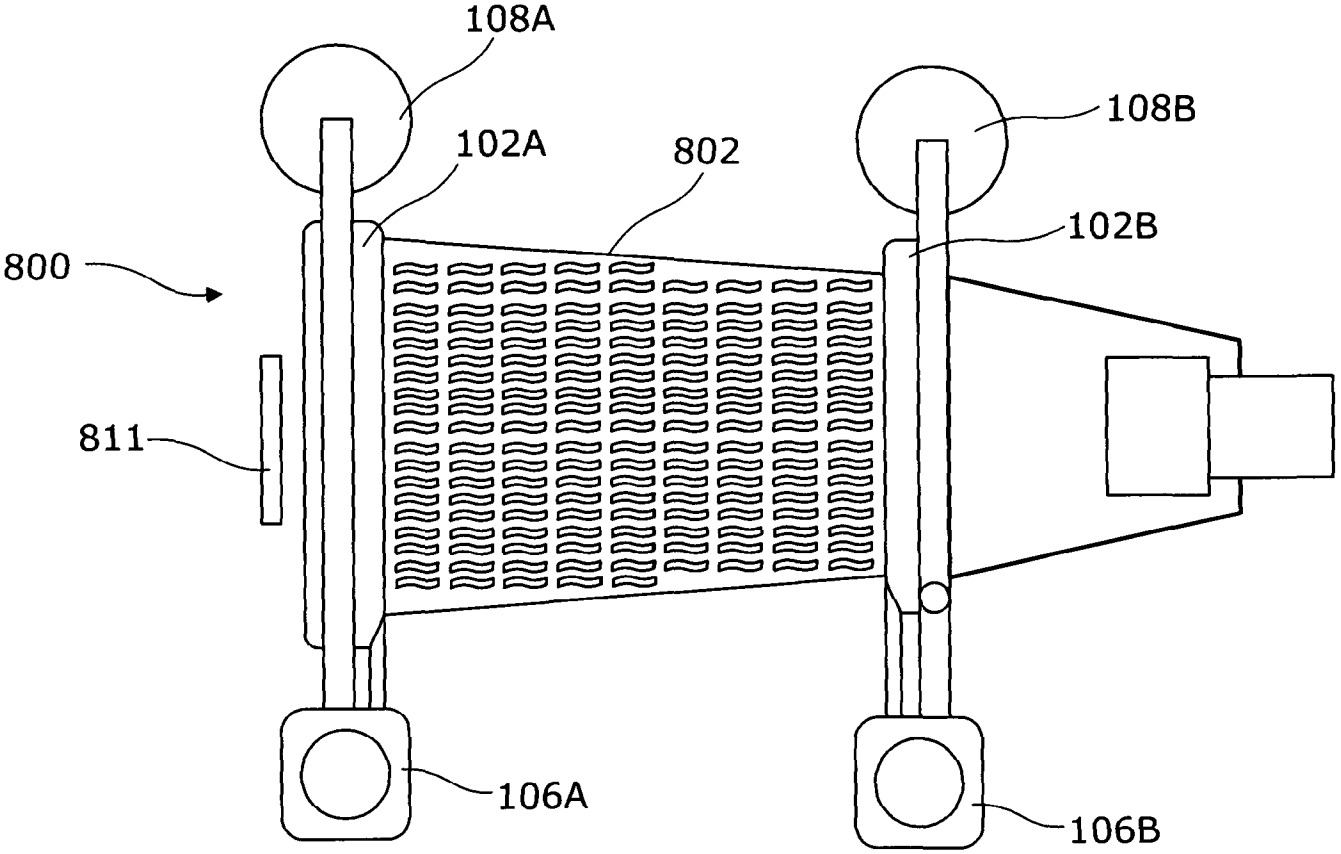
FIG. 9 is a schematic sectional side view of the embodiment of FIG. 9.

FIGS. 8 and 9 show a fourth embodiment 800 of the cooling device. Again, components identical/similar to the previously-described embodiments have been given the same reference numerals. In this fourth illustrated embodiment, all the walls 802 of the housing may be Peltier plates and may be further encased in turbulator-arrangement walls that form cooling blocks. Thus, the entire body of the radiators can be insulated. The walls may be formed as a single box-like Peltier unit and effectively encased in a fluid cooling jacket comprising the turbulator-arrangement walls (and may be further insulated). This embodiment can further comprise a fan 811 located adjacent the intake/first radiator 102A. It will be understood that one or more such fans can be used with any of the other embodiments to provide additional cooling and may be placed in locations other than adjacent the first radiator.

Figure 10:
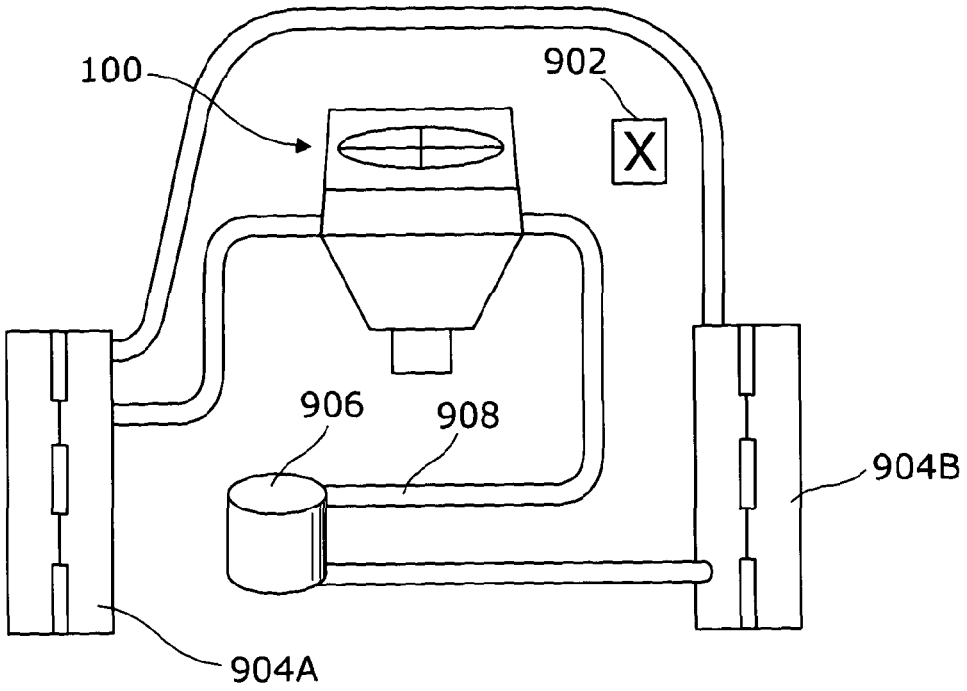
FIGS. 10-12 show examples of a supplementary cooling systems that can be used with the apparatus.

FIG. 10 shows a supplementary cooling system that can be used to provide additional cooling for the apparatus described above. The cooling apparatus (e.g. embodiment 100) is located next to a fan 902. A pair of charge heat exchange chambers 904A, 904B can be located to either side of the cooling apparatus 100. The chambers can collect the cooled fluid for passage through a fan-assisted radiator with the purpose of using the subsequent cooled airstream to provide cooled air to any object placed in the airstream, which can comprise the apparatus described above in some cases. The chambers can include Peltier units and can comprise two chambers connected together to sandwich one or more Peltier units. One of the chambers is used to cool the hot side of the Peltier unit and the other can be used to provided fluid cooled as a result of this exchange. In some cases the heat exchangers can include upper and lower chambers, each of which may be of rectangular welded construction containing baffles to create turbulent flow and conduct the fluid along a predetermined path with single ports of ingress and egress. A pump 906 pumps coolant (air or liquid) through conduits 908 connecting the chambers, providing a cool surround for the apparatus 100.

Figure 11:
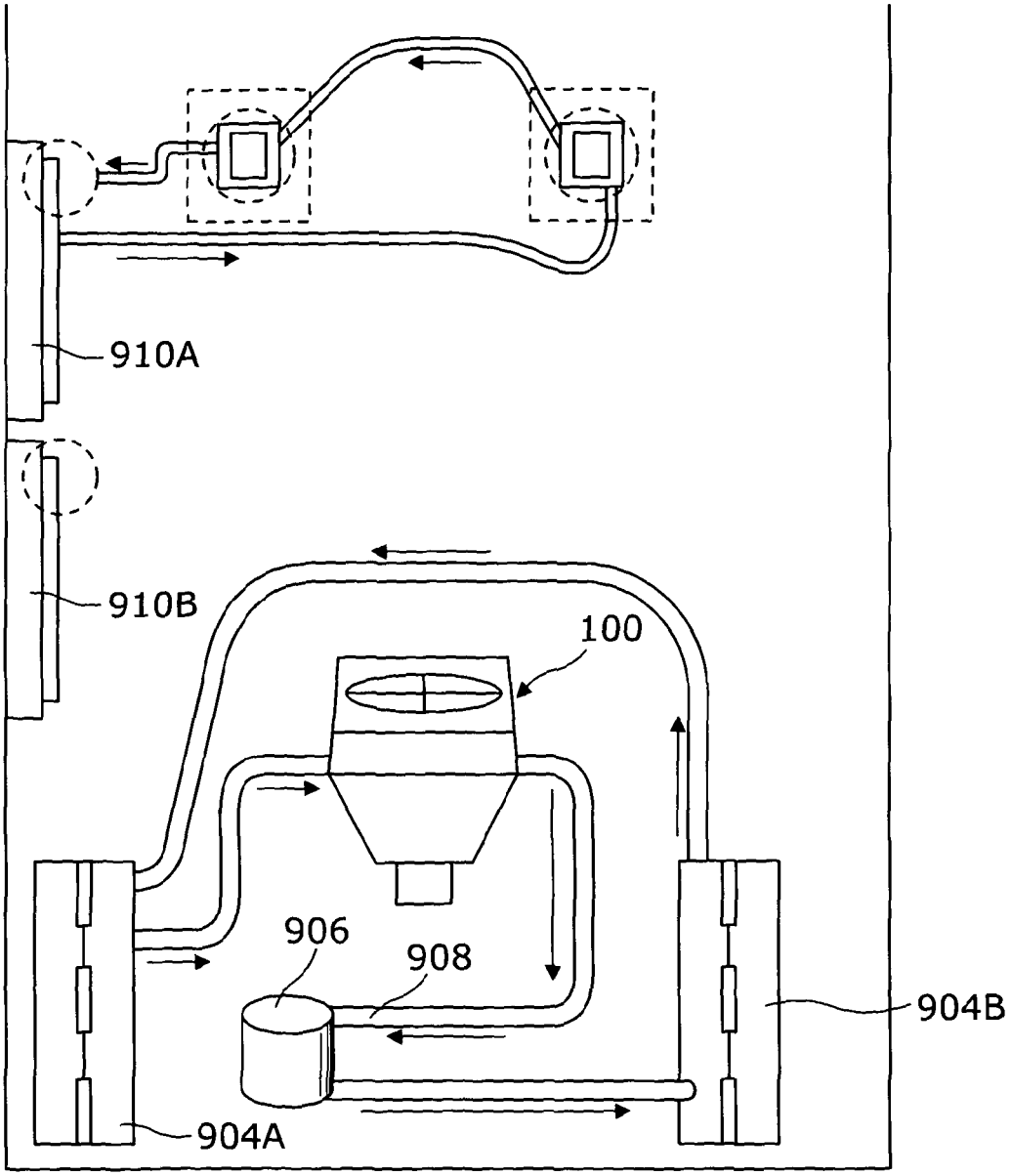

FIG. 11 shows a further refinement of the supplementary cooling system further including heat exchangers 910A, 910B (typically including Peltier units). Such further banks of completely separate Peltier units can provide a separate cooling circuit for the "hot side" of the chambers of FIG. 10. The units can comprise heat transfer blocks connected to a separate radiator. The pump associated with the radiator can circulate fluid through ZALMAN CPU waterblocks situated on top of further Peltier units, which can cool the hot side of the other Peltier units. The independent Peltier plates can be used to draw heat away from the hot side of the primary heat exchangers, thereby providing additional cooling and boosting heat extraction.

Figure 12:
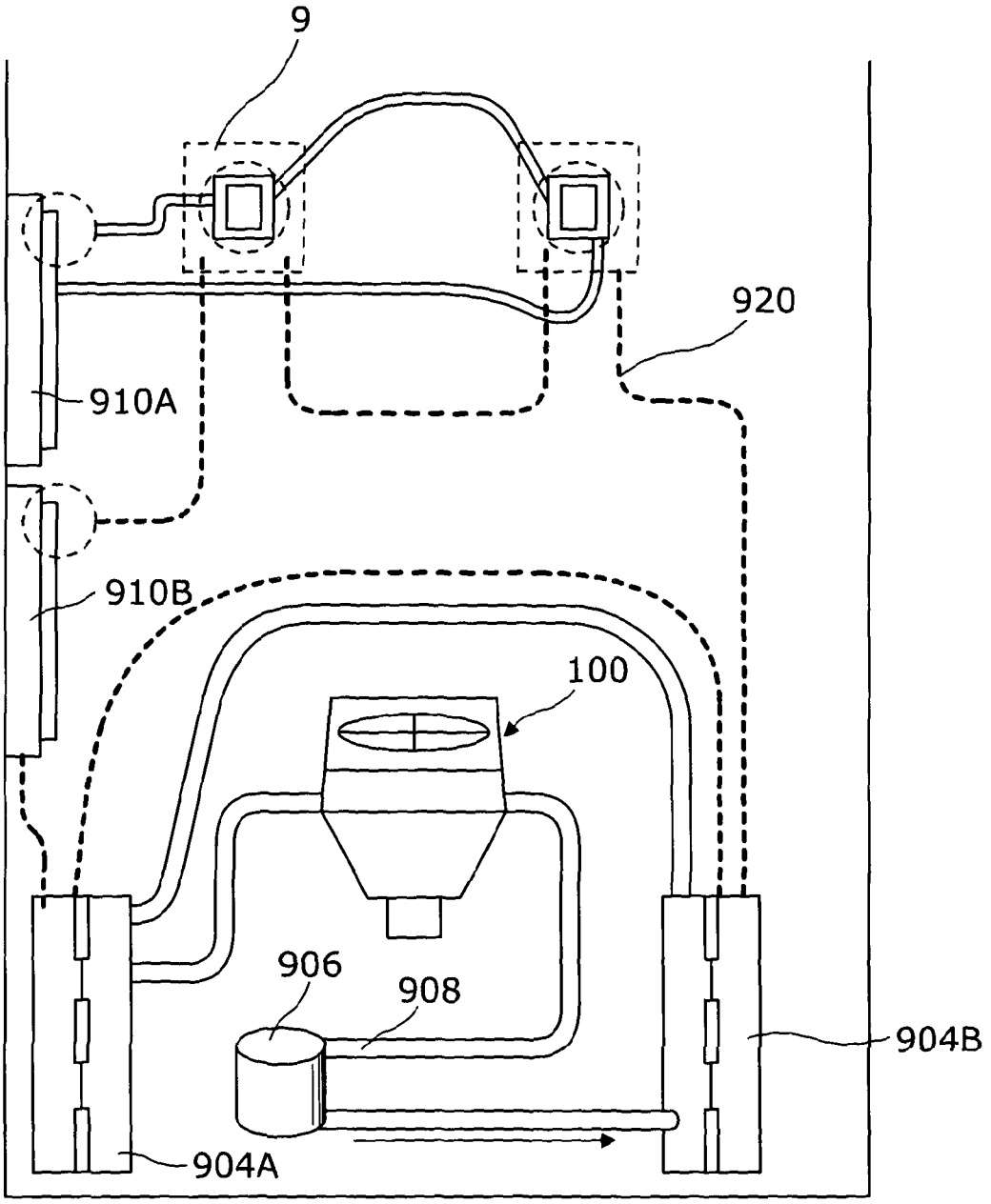

FIG. 12 shows the supplementary cooling system where a conduit 920 connects the heat exchangers 910 to the heat exchange chambers 904 adjacent the apparatus 100. Coolant from the hot sides of both primary heat exchangers can be fed to heat transfer blocks, which are themselves cooled using the secondary Peltier units.

Figure 13:
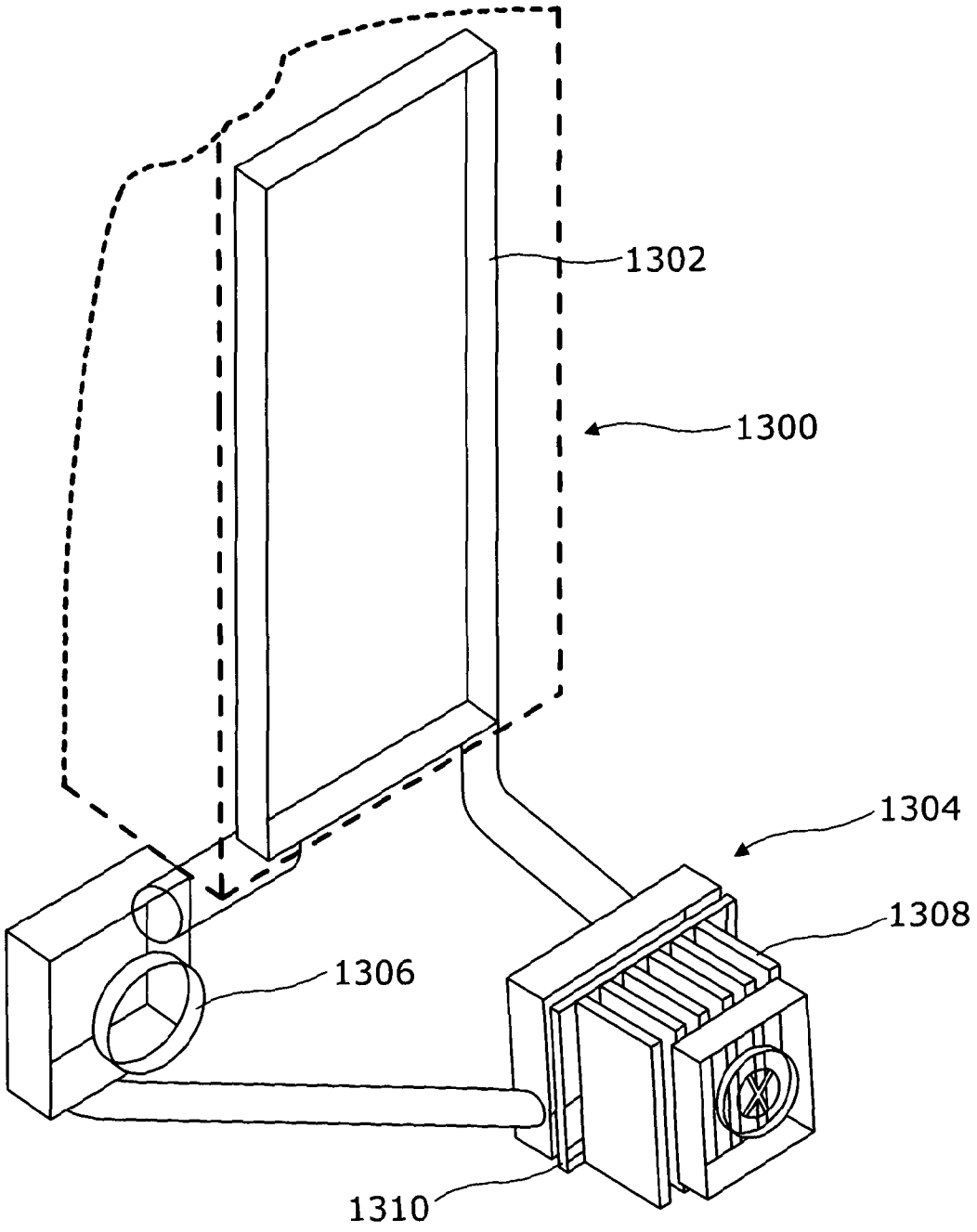

FIG. 13 schematically illustrates example apparatus 1300 that may be used as a refrigerator, cool cabinet or the like. The body of the cabinet may be at least partially formed of turbulator-arrangement walls 1302. A fan unit 1304 may be located adjacent a wall to provide active fluid cooling for it. A pump 1306 can transfer coolant through the fan unit and the wall(s). The rotary fan is located adjacent a heat sink (in the form of a plurality of fins 1308) that are adjacent a Peltier unit 1310. In some cases, one or more Peltier unit may be mounted onto an insulated cross-drilled aluminium exchanger. The apparatus may be partially or fully insulated. In alternative embodiments, the thermoelectric devices may be configured to heat the cabinet, and so the cabinet may be an oven or the like.

Figure 14:
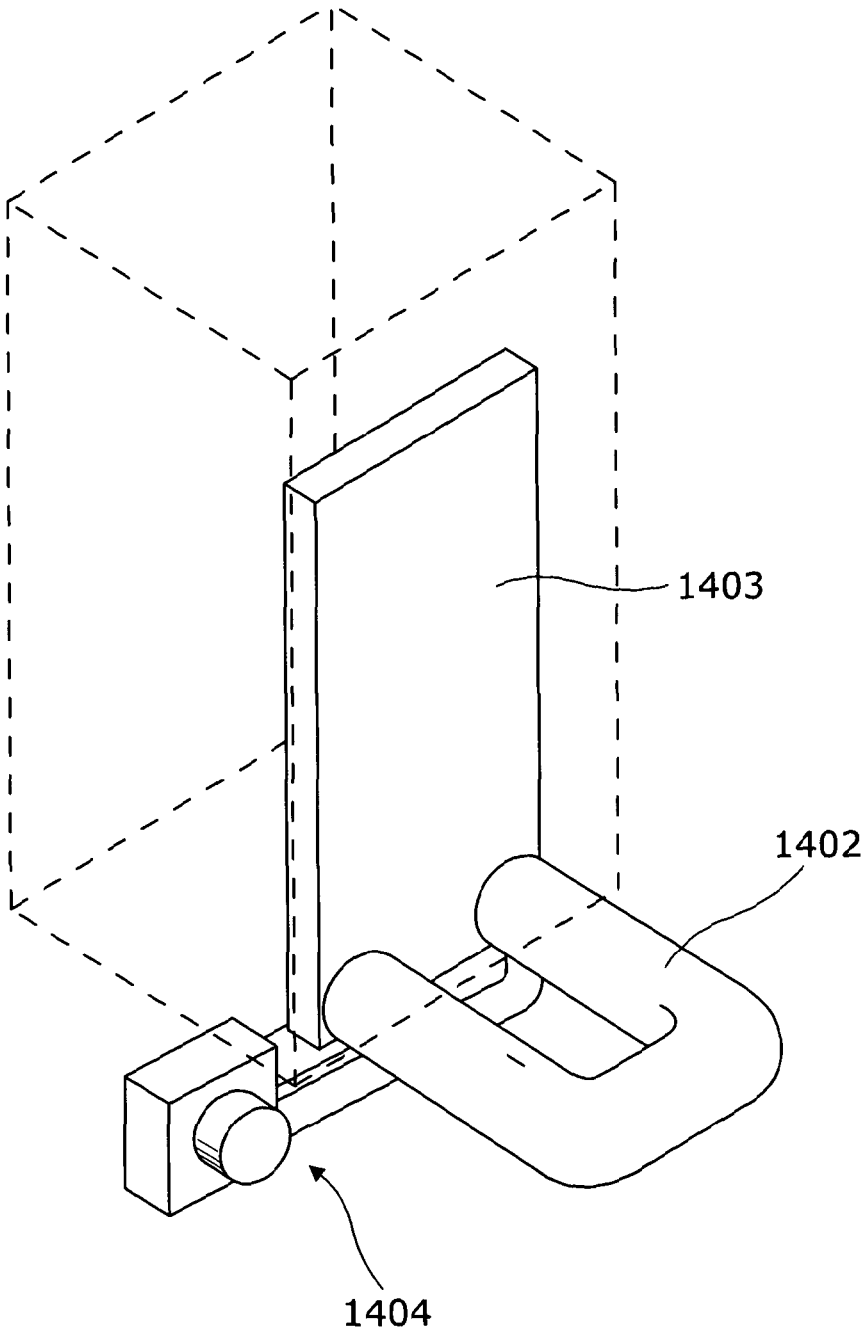

FIG. 14 shows an alternative version of the cool cabinet. Instead of the fan unit of FIG. 13, this version includes a set of Peltier units 1402, in a cylindrical form similar to the earlier embodiments. These are used to cool the coolant within the turbulator-arrangement walls 1403 of the cabinet, along with the pump and conduit arrangement 1404. Conventional cooling matrix comprising fans and fins can be substituted for (or provided in addition to) the turbulator-arrangement walls. Again, the device may be partially or fully insulated.

Figure 15:
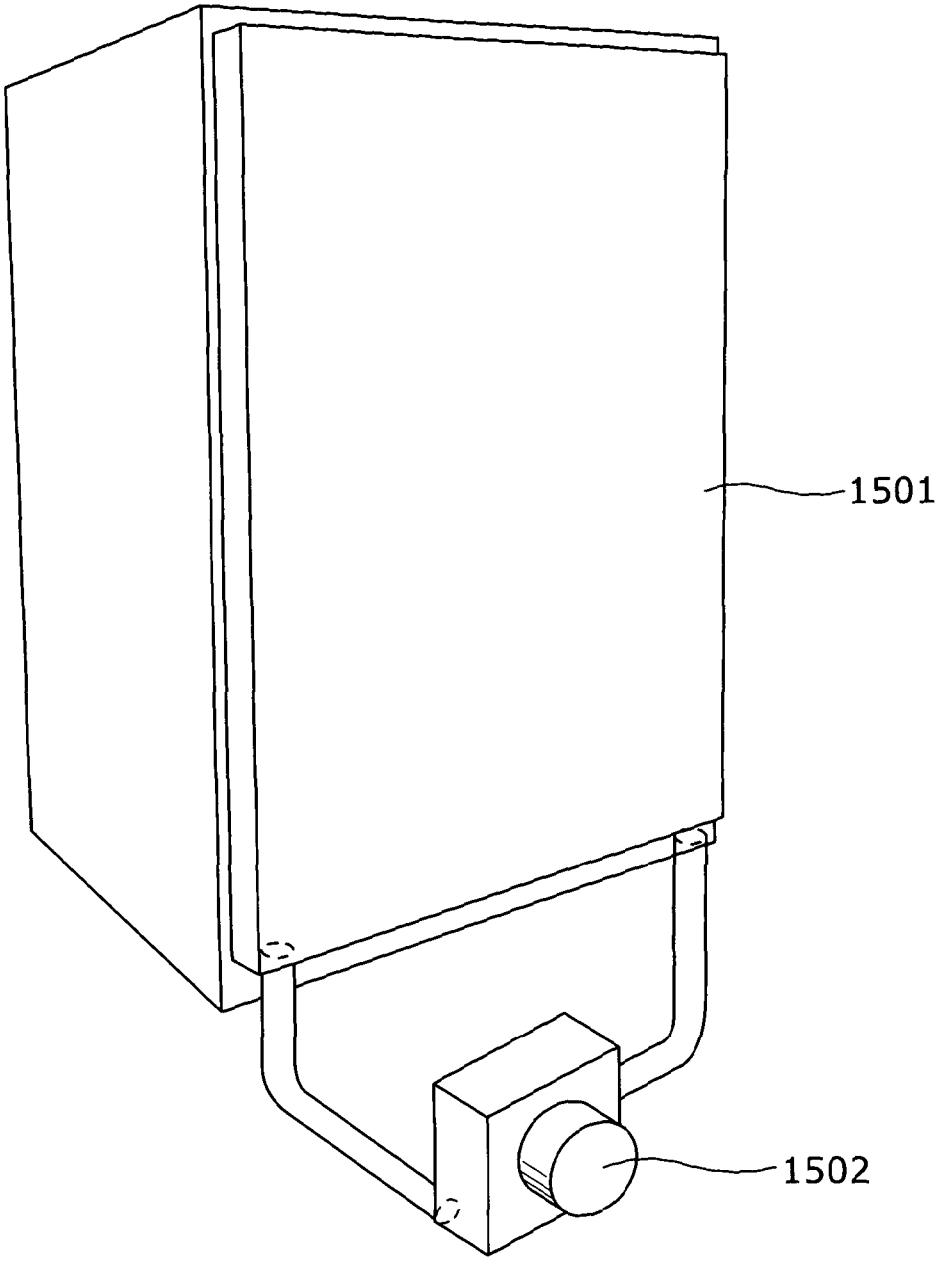

FIG. 15 shows a cooling device where the entire body/housing of the cooling cabinet is formed of a box-like Peltier structure 1501. Turbulator-arrangement walls may additionally be provided, along with a pump 1502 or the like for causing the coolant to flow within the walls.

FIG. 16 shows a cooling apparatus, such as a fridge or cool cabinet, with a Peltier structure 1602 forming part of its internal/external surface (the rear panel in the example). The structure may have finned heat sinks 1604. The device can be equipped with a fan unit if desired. It will be understood that the design of FIG. 16 is exemplary only and that additional/alternative parts of the cooling cabinet could be formed of Peltier structures, e.g. its door, side walls, etc.

FIGS. 16A and 16B show yet another embodiment of the cooling apparatus, which can function as a fridge, cool cabinet or the like. A box-like frame 1612 is arranged to hold at least one shelf. In use, walls (not shown) will cover at least some of the gaps between the framework. The front of the framework may be left open, or a door may be provided. The shelves may be removable or permanently fixed to the frame. In the illustrated example there are two shelves, 1614A, 1614B, positioned near the top of the frame, but it will be appreciated that the location, number and design of the shelves can vary, and not all shelves in the apparatus need be the same. Each shelf can be at least partially hollow to hold coolant. Preferably, the shelves may be formed of the turbulator-like walls. These design features allow them to retain cold and so even if the cooling source is switched off then the cooled shelves (and goods placed upon them) can remain cold, thereby saving energy.

The frame 1612 further includes a box-like container/tub 1616, which can be used to store bottles or the like. Again, at least some of the walls of the container may contain coolant and are preferably turbulator-like walls. Again, it will be appreciated that the location, number and design of the container can vary. Also, for ease of illustration, the shelves and container are shown in outline in the Figures.

A cassette-like cooling unit 1618 is used to provide at least some of the cooling for the apparatus. As can be seen in FIG. 16B, conduits 1620 lead to/from the cooling unit, through the container 1616 and the shelves 1614, in order to transfer coolant through these components before returning to the cooling unit. The conduits may be detachable by dry-break joints for ease of maintenance/replacement. The cooling unit can comprise a fan and a pump for transferring the coolant through the fan unit and the walls of the components.

The fan can be located adjacent a heat sink inside the cooling unit (which may be in the form of a plurality of fins) and also adjacent a Peltier unit inside the cooling unit. In some cases, more than one Peltier plates and cold blocks may be mounted within the cooling unit. The cooling unit may be partially or fully insulated. A thermostat/controller will also be included in the cooling unit and any cables, etc, may be plug and socket type arrangements for convenience. As illustrated by the arrow 1620, the cooling unit can be slidably mounted within the framework 1612 for easy removal and installation. In general, the components of the removable cooling unit may be similar to those shown in FIG. 13, above.

Thus, the shelves 1614 and container 1616 are connected in series for cooling by the transferred fluid. They are cooled by the cooling unit, which can be thermostatically controlled. The arrangement is designed for easy maintenance. In some cases one or more of the walls fitted to the frame 1612 may be cooled in a similar manner.

An air curtain normally associated with cooling devices is not required on the open front of the cooler described above because of the cooled shelves and the retention of cold within the stock contained therein. The energy consumption of the apparatus (particularly in view of the design of the fluid filled shelves) can have an 80% saving over conventional coolers over a 24 hour period, in term of apparatus of comparable size and capacity. The maximum noise generation on open and closed fronted embodiments can be in the region of 30 dB. A battery back-up (e.g.) may also be provided to the cooling unit for use in the event of mains failure to maintain electrical supply for shelf temperature.

FIGS. 16C and 16D show an embodiment 1620 in the form of a cooling device that can, in use, be mounted on a table, counter or the like. The device has a square/rectangular box-shaped housing 1622 having a flat upper surface 1624, which may be solid or may have at least one aperture/slot. The housing includes at least one conduit 1626 for transferring cooled fluid beneath the flat surface. The at least one conduit may be in contact with, or located adjacent (e.g. no more than 1 cm away from) the underside of the flat surface.

The device further includes an additional housing 1628 that, in the example, is located at one end of the flat surface and projects above it. The additional housing can include cooling/control components, such as pumps, thermostats, Peltier plate(s), and in some cases a power supply, etc, for transferring the fluid in a closed loop between one end 1626A of the conduit to another end 16268. It will be understood that the conduit shown is one example only and that other arrangements could be provided inside the main housing 1622. In use, the device may be set up on a bar or table and drinking vessels, such as glasses, can be placed on the flat surface for cooling (or being kept cool), whilst their upper portions are exposed to the atmosphere.

FIG. 16E shows an alternative embodiment 1650 comprising a table having an upper surface 1652 and supporting legs 1654. The upper surface acts as a cover to a compartment formed within at least part of the main body of the table in which one or more conduits 1656 are located. Again, the at least one conduit may be in contact with, or located adjacent (e.g. no more than 1 cm away from) the underside of the flat surface.

In the illustrated embodiment there is a unit or cassette 1658 removably mounted (e.g. by fixing means, such as screws, or in a manner not requiring use of tools to mount/de-mount, e.g. by having portions that slidably engage with channels on the underside of the table). The unit/cassette includes cooling/control components, such as pumps, thermostats, Peltier plates, and in some cases a power supply, etc, for allowing cooled fluid to flow through the at least one conduit. Again, the upper surface of the table can be used to keep drinks cool. It will be understood that the design and dimensions of the table can vary, e.g. it can have any shape (e.g. circular, square or irregular top) and any number (from one upwards) of legs and may be formed of various materials, e.g. glass, metal, wood, etc. Further embodiments may form at least part of a bar or the like.

FIG. 16F is a cross-sectional illustration of another embodiment 1660 of the cooling device that can be used as a table. The table comprises a main body 1661 having sidewalls and a base. A set of supporting legs 1662 are attached to the base. An upper surface of the table is formed by a plate 1663, which can be formed of any rigid material, preferably thermally conductive material such as an alloy. In the example, the plate has a thickness of around 4 mm and dimensions of 1 m×1 m and forms the entire upper surface of the table. However, it will be understood that this can vary and that in other embodiments only part(s) of the upper surface of the table will be formed of the plate(s).

Fixed underneath the plate 1663 is a heat sink/cooling plate 1664. In the illustrated embodiment, the dimensions of the heat sink generally match those of the plate, but it will be understood that this can vary, e.g. one or more heat sinks of smaller dimensions may be located under particular areas of the plate. The example heat sink is formed of alloy and may comprise the cold plate of a Peltier arrangement. The heat sink can include at least one channel/bore 1665 that extends through from its lower surface to its upper surface. In the example, the heat sink has a grid/matrix-like arrangement of bores through it, but it will be understood that the number and arrangement of bores/channels can vary. In some embodiments, there may be at least one channel/bore in the plate 1663, at least some of which may be aligned with the bores in the heat sink. At least one fan device 1666 is also included in the chamber within the main body 1661 of the table. The axes of the fan devices are normally parallel with the bores in the cooling plate. In the example, there are two fans attached to the lower surface of the heat sink 1664, although it will be appreciated that the number and location of the fans can vary.

Also shown in the Figure is a housing 1667, which may be removably fitted to the table main body/other components. The housing can include a power supply, thermostats and other components/control apparatus (not shown) for the cooling device. In use, the heat sink 1664 cools the upper plate 1601. The upper plate is further cooled by the fan(s) 1666 directing cold air through the channels 1665 onto the upper plate (and possibly through any bores in that plate), thereby increasing the cooling effect. Again, it will be appreciated that variations to the embodiment of FIG. 16F are possible and the cooling components can be fitted in a bar, cooling cabinet or a portable table-top device.

FIG. 16G shows another embodiment 1670 that is designed to cool beverages, e.g. draught beers, that are dispensed via a conventional pump 1672 and valve/handle 1674 mechanism. A conduit 1676 that leads to the pump has its other end connected to a heat exchanger 1678. The heat exchanger is in the form of a housing that contains a Peltier cooling block 1680. A second pump 1682 pumps cooling fluid through conduits 1684 that are connected to a cooling device 1686, which can include one or more Peltier unit.

A further conduit 1687 connects the heat exchanger 1678 to a container 1688. Beverage is transferred to this container from a beverage source 1690. The container can includes at least one conduit (a coil-shaped conduit 1692 in the example) through which fluid cooled by a cooling arrangement comprising a second heat exchanger 1694 that includes at least one Peltier cooling block 1696. Conduits 1698 transfer cooling fluid to/from a radiator 1699 by means of a pump 1697. In one configuration, the container 1688 is at least partially filled with beverage from the source and the coil-shaped conduit 1692 cools it before the beverage is transferred out via conduit 1686 upon demand. In an alternative version, the beverage may be transferred into the conduit 1692 and the fluid that at least partially surrounds it in the container 1688 is used to cool the beverage before it is dispensed.

FIG. 17 shows an embodiment of the cooling apparatus being used for providing underfloor heating. A Peltier unit 1702 is supported on joists 1704 beneath a floor 1705. The Peltier unit has a plurality of fins 1706 on its lower surface that function as heat sinks (gaps are provided around the supporting joists). The unit may be in contact with the floor, or may be spaced apart from it. The unit may extend below an entire floor, or below parts of it. The units may be of standard sizes for ease of replacement/fitting. The units will typically be square or rectangular in shape, but it will be understood that different shapes can be produced.

The apparatus described herein can be produced to virtually any desired shape and in a variety of sizes. Versions not including subsidiary cooling systems in particular can be light and compact in design. Applications of the apparatus can vary, e.g. the embodiments of FIGS. 1 to 12 can be used as charge coolers in engines, whilst the later embodiments can form the cooling cabinets or ovens, etc.

FIGS. 18A and 18B show an example cooling apparatus 1802 in the form of a race car air box (which is normally located near the driver's head in use). Conventionally, the complete structure of the air box is formed by an aluminium contoured structure. In the illustrated embodiment, the air box is formed from a Peltier structure with its "hot" side cooled by vaned alloy heat sinks. The temperature of the air box can be controlled electronically (details not illustrated) in accordance with the engine builders' requirements. Fins

1804 may be provided on at least part of the outer surface of the box. It will be understood that the exact design of the box can vary from the illustrated example and that the apparatus can be used to control the temperature of air entering through other structures that are in flow communication with a combustion engine. The cooling effect provided by embodiments of the apparatus can improve the efficiency of the vehicle, as well as requiring little energy to operate.

FIGS. 19A and 19B illustrate another embodiment where a cooling arrangement 1902 is fitted inside the race car intake unit 1904, which is a component of a fuel-air mixture/combustion engine. In the example, the cooling arrangement is coil shaped and extends substantially from the intake end of the intake unit to the end that is nearest the engine. The cooling arrangement is hollow and is used to allow cooling fluid to flow from an inlet conduit 1906A, though the coil-shaped portion and back to an outlet conduit 1906B. It will be understood that variations to the shape and dimensions of the cooling arrangement can be made. In some embodiments, a variable-speed fan 1908 may be fitted may be fitted adjacent the throttle opening/intake end of the intake unit. Referring to FIG. 20, the inlet conduit 1906A stems from a heat exchanger component 2002 that can be filled with fluid. The heat exchanger includes a Peltier unit that has a cold block 2004 to cool the hot side of the unit, as well as the surrounding fluid. A heat exchanger inlet conduit 2006 is used to transfer cooling fluid into the cold block from a radiator component 2008 that can be fitted with a fan 2010. There is also a heat exchanger outlet conduit 2011 that transfers fluid from the cold block to the radiator component 2008, by means of a pump 2012. Dry break joints 2014, 2016 may be provided in the heat exchanger inlet and outlet conduits. Dry break joints 2017A, 2017B may be provided for the cooling arrangement inlet 1906A and/or outlet 1906B. Cooling fluid is transferred from the outlet conduit of the coil-shaped cooling arrangement 1902 into the heat exchanger by means of a pump 2018.

FIG. 21 is a schematic illustration of how an embodiment of the present invention can be used to cool a plenum chamber 2102, which is typically fitted between the intake and the cylinders of the engine. This embodiment can be used instead of, or in addition to, the earlier embodiments. A cooling arrangement 2103 is fitted within the plenum chamber and comprises a hollow conduit that is used to allow cooling fluid to flow from an inlet 2104, though a series of convolutions/conduit matrix 2106 and then to an outlet 2108. It will be understood that variations to the shape and dimensions of the cooling arrangement shown can be made.

Similar to the embodiment of FIG. 20, the inlet 2104 stems from a heat exchanger 2109, which includes a Peltier unit that has a cold block 2110 to cool the hot side of the unit, as well as the surrounding fluid. A heat exchanger inlet conduit 2112 is used to transfer cooling fluid into the cold block from a radiator component 2114 that can be fitted with a fan 2116. There is also a heat exchanger outlet conduit 2117 that transfers fluid from the cold block to the radiator component 2114, by means of a pump 2118. Dry break joints 2120, 2122 may be provided for the heat exchanger inlet 2112 and/or outlet 2117 conduits. Dry break joints 2124, 2126 may be provided for the cooling arrangement inlet 2104 and/or outlet 2108. Cooling fluid is transferred from the outlet 2108 of the cooling arrangement 2104 into the heat exchanger by means of a pump 2128.

FIG. 22 is a diagram showing a possible configuration of the cooling device in a vehicle engine. An air intake 2202 is connected to a turbocharger 2204. The cooling device 2206 is fitted between the turbocharger and the combustion engine 2208. The cooling device receives the compressed air leaving the turbo charger and cools it down before it reaches the engine, thereby replacing a conventional intercooler. An exhaust 2210 leads from the engine back to the turbocharger.

The cooling device 2206 can include any suitable one of the embodiments described above, including the coil-shaped conduit containing fluid cooled by the thermoelectric device. The cooling device has advantages over a conventional intercooler, including being lighter in weight (some embodiments offer an 80% weight saving). Further, dry break joints can be used to fit the cooling device to the turbocharger 2204 and/or the engine 2208. Electrical connections between the cooling device and those components can also be plug/socket type arrangements to assist installation, maintenance, etc. The same cooling device can be used for both turbo and non-turbo engines. Tests have shown that typical compressed air induction temperature leaving the turbocharger is 50% lower than ambient. In an alternative embodiment the cooling device 2206 can be used to cool down the ambient air in/around the intake component 2202 instead of, or in addition to, replacing the intercooler.

The invention claimed is:

1. A cooling apparatus comprising: a thermoelectric device having a hot side and a cold side and being positioned in fluid communication with a component to be cooled, wherein said component has an input and an output and contains a coolant, the cooling apparatus further comprising a pump for causing said coolant to flow from said output to said input via a conduit through said cooling apparatus, said conduit being thermally coupled to the cold side of said thermoelectric device and including a turbulator for turbulating said coolant as the coolant flows through the apparatus; wherein said conduit comprises a chamber defined by two opposing walls, and said turbulator is provided on the inner wall of at least one of said walls; wherein said turbulator comprises a grid-like arrangement of wave-like strips, each wave-like strip comprising alternative peaks and troughs, the direction of travel of coolant through the chamber being substantially parallel to a plane of said two opposing walls and following a fluid flow path over said peaks and troughs; and wherein said wave-like strips include one-way intersections or bores between one or more peaks and troughs thereof configured to direct coolant within said chamber toward at least one of said walls.

2. The apparatus according to claim 1, wherein the thermoelectric device comprises a Peltier device including a heat sink covering a hot side of the Peltier device.

3. The apparatus according to claim 1, wherein the thermoelectric device has a plurality of outwardly extending fins that function as heat sinks.

4. The apparatus according to claim 1, wherein the hot side of the thermoelectric device is cooled by a liquid jacket or a fan.

* * * * *